US011245184B2

(12) United States Patent
Takai et al.

(10) Patent No.: US 11,245,184 B2
(45) Date of Patent: Feb. 8, 2022

(54) ANTENNA DEVICE AND ELECTRICAL APPLIANCE

(71) Applicant: PANASONIC INTELLECTUAL PROPERTY MANAGEMENT CO., LTD., Osaka (JP)

(72) Inventors: Hitoshi Takai, Osaka (JP); Taichi Hamabe, Kanagawa (JP); Kazuhiro Imai, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/628,635

(22) PCT Filed: Dec. 25, 2018

(86) PCT No.: PCT/JP2018/047452
§ 371 (c)(1),
(2) Date: Jan. 3, 2020

(87) PCT Pub. No.: WO2019/193793
PCT Pub. Date: Oct. 10, 2019

(65) Prior Publication Data

US 2020/0127375 A1 Apr. 23, 2020

(30) Foreign Application Priority Data

Apr. 6, 2018 (JP) ..... JP2018-074153

(51) Int. Cl.
*H01Q 1/52* (2006.01)
*H01Q 5/378* (2015.01)
(Continued)

(52) U.S. Cl.
CPC ..... *H01Q 1/525* (2013.01); *H01Q 1/38* (2013.01); *H01Q 1/48* (2013.01); *H01Q 5/378* (2015.01)

(58) Field of Classification Search
CPC ..... H01Q 1/52; H01Q 1/525; H01Q 5/378; H01Q 1/48; H01Q 1/38; H01Q 1/24; H01Q 15/006; H01Q 9/16
See application file for complete search history.

(56) References Cited

U.S. PATENT DOCUMENTS 6,025,811 A * 2/2000 Canora ..... H01Q 1/36 343/793
6,181,278 B1 * 1/2001 Kakimoto ..... H01Q 9/0457 343/700 MS
(Continued)

FOREIGN PATENT DOCUMENTS

JP 2012-235224 A 11/2012
JP 2015-070542 A 4/2015
(Continued)

OTHER PUBLICATIONS

International Search Report and Written Opinion dated Mar. 26, 2019 in International Application No. PCT/JP2018/047452; with partial English translation.
(Continued)

*Primary Examiner* — Graham P Smith
*Assistant Examiner* — Jae K Kim
(74) *Attorney, Agent, or Firm* — McDermott Will and Emery LLP

(57) ABSTRACT

An antenna device includes: a first conductor layer; a second conductor layer located opposite to the first conductor layer; and a third conductor layer located opposite to the second conductor layer. The first conductor layer includes: a feed element; a first grounding element located next to the feed element in a first direction and grounded; and a parasitic
(Continued)

element located along the feed element and the first grounding element and insulated from the feed element and the first grounding element. The second conductor layer includes: a floating element located opposite to the feed element and insulated from the first conductor layer; and a second grounding element located opposite to the first grounding element and next to the floating element and grounded. The third conductor layer includes a third grounding element grounded.

9 Claims, 30 Drawing Sheets

(51) Int. Cl.
*H01Q 1/38* (2006.01)
*H01Q 1/48* (2006.01)

(56) References Cited

U.S. PATENT DOCUMENTS 9,293,419 B2 * 3/2016 Nakamura ..... H01L 23/13
9,466,886 B2 * 10/2016 Kashino ..... H01Q 19/22
9,711,861 B2 * 7/2017 Kashino ..... H01Q 13/106
9,735,456 B2 * 8/2017 Kawai ..... H01P 1/20345
10,014,572 B2 * 7/2018 Tagi ..... H01Q 1/521
2004/0150561 A1 * 8/2004 Tillery ..... H01Q 1/246 343/700 MS
2005/0054317 A1 * 3/2005 Ro ..... H01Q 9/0414 455/269
2006/0131611 A1 * 6/2006 Kaluzni ..... H01L 23/49827 257/206
2007/0176827 A1 * 8/2007 Itoh ..... H01Q 21/08 343/700 MS
2007/0222696 A1 * 9/2007 Wikstrom ..... H01Q 21/067 343/797
2008/0218418 A1 * 9/2008 Gillette ..... H01Q 13/18 343/700 MS
2012/0261478 A1 * 10/2012 Sonoda ..... H01Q 7/00 235/492
2016/0126635 A1 * 5/2016 Hamabe ..... H01Q 1/48 343/700 MS
2016/0126637 A1 * 5/2016 Uemichi ..... H01Q 13/22 343/771
2018/0183142 A1 * 6/2018 Hamabe ..... H01Q 9/30
2019/0020110 A1 * 1/2019 Paulotto ..... H01Q 19/005
2019/0027802 A1 * 1/2019 Noori ..... H01Q 3/30
2019/0165475 A1 * 5/2019 Shibata ..... H01Q 19/005
2019/0379134 A1 * 12/2019 Paulotto ..... H01Q 3/28
2020/0106179 A1 * 4/2020 Izawa ..... H01Q 21/065

FOREIGN PATENT DOCUMENTS

JP 2016-146558 A 8/2016
WO 2017/038045 A1 3/2017

OTHER PUBLICATIONS

European Search Report dated Apr. 23, 2021, issued in counterpart European Patent Application No. 18913904.1.

* cited by examiner

ANTENNA DEVICE AND ELECTRICAL APPLIANCE

CROSS-REFERENCE OF RELATED APPLICATIONS

This application is the U.S. National Phase under 35 U.S.C. § 371 of International Patent Application No. PCT/JP2018/047452, filed on Dec. 25, 2018, which in turn claims the benefit of Japanese Application No. 2018-074153, filed on Apr. 6, 2018, the entire disclosures of which Applications are incorporated by reference herein.

TECHNICAL FIELD

The present disclosure relates to an antenna device and an electrical appliance that includes the antenna device.

BACKGROUND ART

Patent literature (PTL) 1 and PTL 2 disclose antenna devices utilizing an artificial magnetic conductor (AMC).

CITATION LIST

Patent Literature

PTL 1: Japanese Unexamined Patent Application Publication No. 2015-70542

PTL 2: Japanese Unexamined Patent Application Publication No. 2016-146558

SUMMARY OF THE INVENTION

Technical Problem

The present disclosure provides an antenna device that improves the directivity to a predetermined direction and the isolation from another antenna.

Solution to Problem

The antenna device according to the present disclosure includes: a first conductor layer; a second conductor layer that is located opposite to the first conductor layer; a first dielectric layer that is located between the first conductor layer and the second conductor layer; a third conductor layer that is located opposite to the second conductor layer; and a second dielectric layer that is located between the second conductor layer and the third conductor layer. In this antenna device, the first conductor layer includes: a feed element to which power is supplied; a first grounding element that is located next to the feed element in a first direction via a first gap and grounded; and a parasitic element that is located along the feed element and the first grounding element and insulated from the feed element and the first grounding element, the second conductor layer includes: a floating element that is located opposite to the feed element and the parasitic element and insulated from the first conductor layer; and a second grounding element that is located opposite to the first grounding element and the parasitic element and next to the floating element in the first direction via a second gap, and grounded, and the third conductor layer includes a third grounding element that is located opposite to the floating element and the second grounding element and grounded.

Advantageous Effect of Invention

The antenna device according to the present disclosure improves the directivity to a predetermined direction and the isolation from another antenna.

DESCRIPTION OF EXEMPLARY EMBODIMENTS

Figure 1:
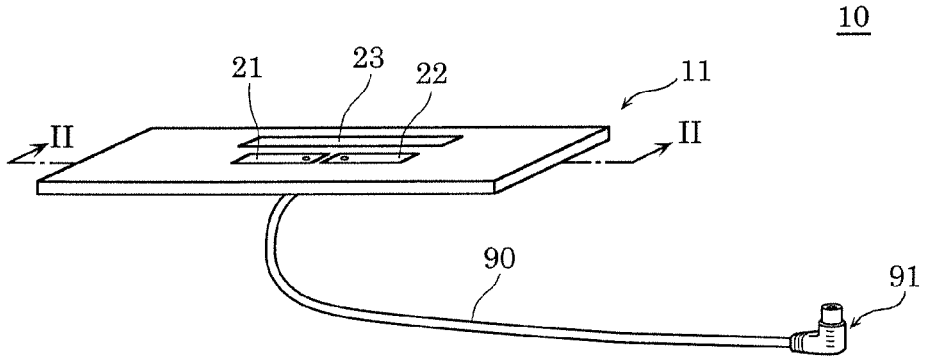
FIG. 1 is a perspective view of the configuration of an antenna device according to Embodiment 1.

Findings that Form the Basis of the Present Disclosure

First, the findings that form the basis of the present disclosure will be described.

In recent years, wireless terminals compliant with a wireless local area network (LAN) standard, Bluetooth®, or other standards have been increasingly incorporated into home appliances such as televisions, in addition to information devices such as personal computers. When mounted on a television, wireless terminals are usually placed on the rear surface (back) of the television from the standpoint of outer look and design. Meanwhile, wireless terminals compliant with a Bluetooth® standard usually communicate with a remote control, a headphone, or other wireless devices used in front of a television. For this reason, such wireless terminals are required to radiate an electromagnetic wave toward the front of the television. However, when a wireless terminal compliant with a Bluetooth® standard is placed at the rear surface of the television as described above, the television body and so forth inhibit the propagation of an electromagnetic wave radiated from the antenna of such wireless terminal toward the front of the television. Also, when a wireless terminal compliant with a wireless LAN standard operating in the 2.4 GHz band and a wireless terminal compliant with a Bluetooth® standard are mounted on a television and used at the same time, a problem of internal mutual interference between these wireless terminals occurs. From this standpoint too, the placement of two wireless terminals at the rear surface of a television poses a drawback because one of the wireless terminals radiates an electromagnetic wave toward the other wireless terminal, leading to the possibility of an increased internal mutual interference between these wireless terminals.

In view of the above, wireless terminals are required to prevent the impairment of the outer look of a television, etc., while ensuring the radiation of an electromagnetic wave toward the front and preventing the internal mutual interference.

Antennas disclosed in PTL 1 and PTL 2 are known as small and thin antennas that prevent the impairment of the outer look of a television and so forth. However, there is no known technology that prevents the propagation of electromagnetic waves through space between the antennas of two wireless terminals.

The present disclosure has been conceived in view of the above findings and it provides an antenna that improves the directivity in a predetermined direction and the isolation from another antenna.

The following describes in detail the embodiments with reference to the drawings where appropriate. Note, however, that more detailed description than is necessary may be omitted. For example, detailed description of a well-known matter or repetitive description of a substantially identical configuration may be omitted. This is to prevent the following description from becoming unnecessarily redundant and to facilitate the understanding of those skilled in the art.

Also note that the inventors provide the accompanying drawings and the following description for those skilled in the art to fully understand the present disclosure, and thus that these do not intend to limit the subject recited in the claims.

Embodiment 1

The following describes antenna device 10 according to Embodiment 1.

[1-1. Configuration of Antenna Device]

First, with reference to FIG. 1, the configuration of antenna device 10 according to the present embodiment will be described. FIG. 1 is a perspective view of the configuration of antenna device 10 according to the present embodiment. Antenna device 10 is a device that transmits and receives an electromagnetic wave that has undergone signal-based modulation. Antenna device 10 according to the present embodiment is a device compliant with a Bluetooth® standard that transmits and receives an electromagnetic wave in the 2.4 GHz band.

As shown in FIG. 1, antenna device 10 includes printed wiring board 11 and coaxial cable 90.

Coaxial cable 90 is a cable that guides an electromagnetic wave. Coaxial cable 90 has one end connected to printed wiring board 11 and the other end connected to another device. The other end of coaxial cable 90 includes coaxial connector 91.

Figure 2:
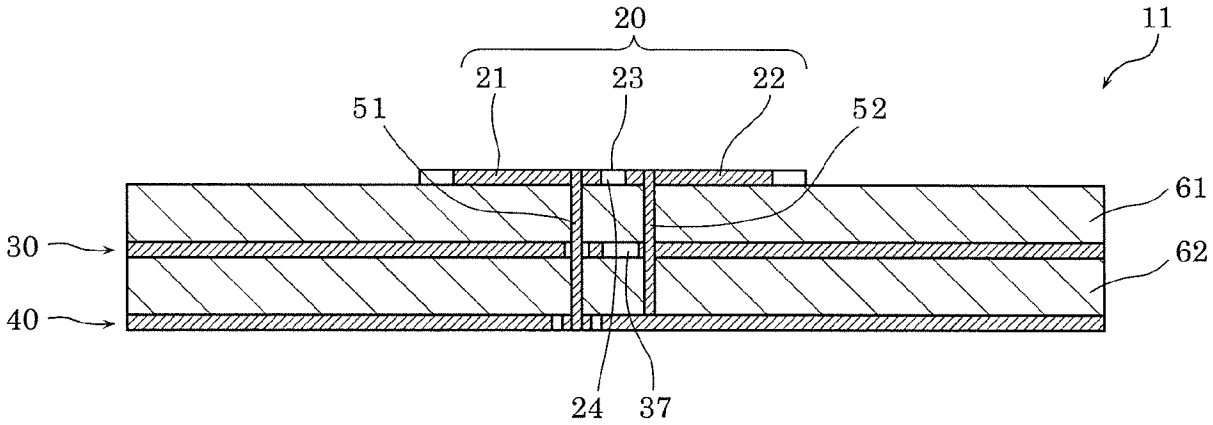
FIG. 2 is a cross-sectional view of a printed wiring board according to Embodiment 1.
Figure 3:
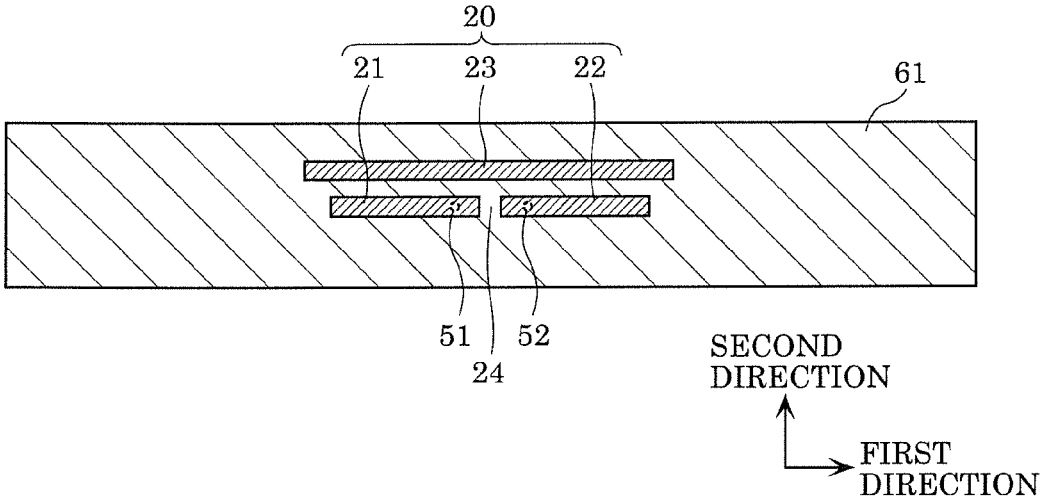
FIG. 3 is a top view of a first conductor layer of the printed wiring board according to Embodiment 1.
Figure 4:
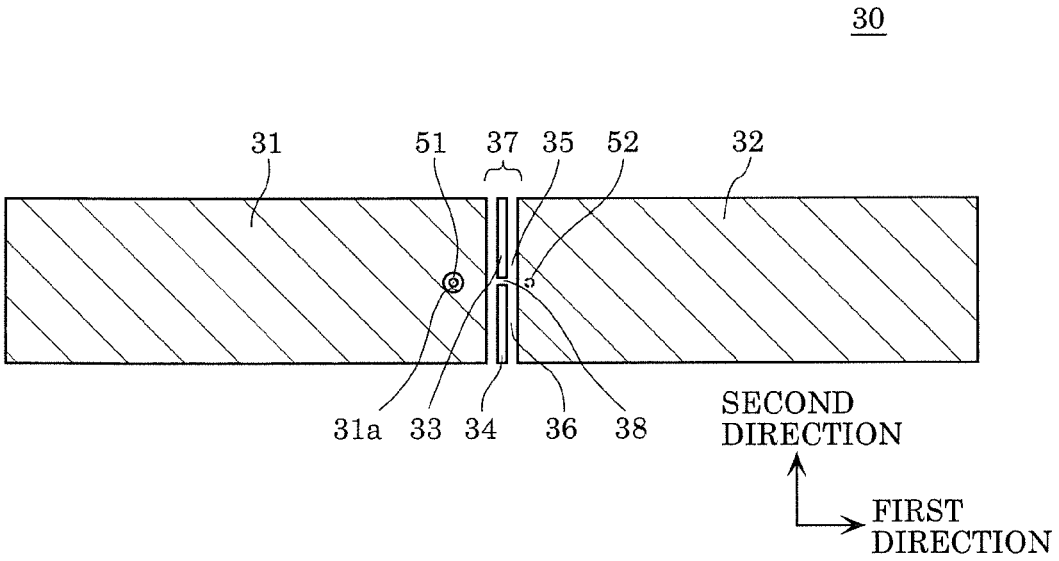
FIG. 4 is a top view of a second conductor layer of the printed wiring board according to Embodiment 1.
Figure 5:
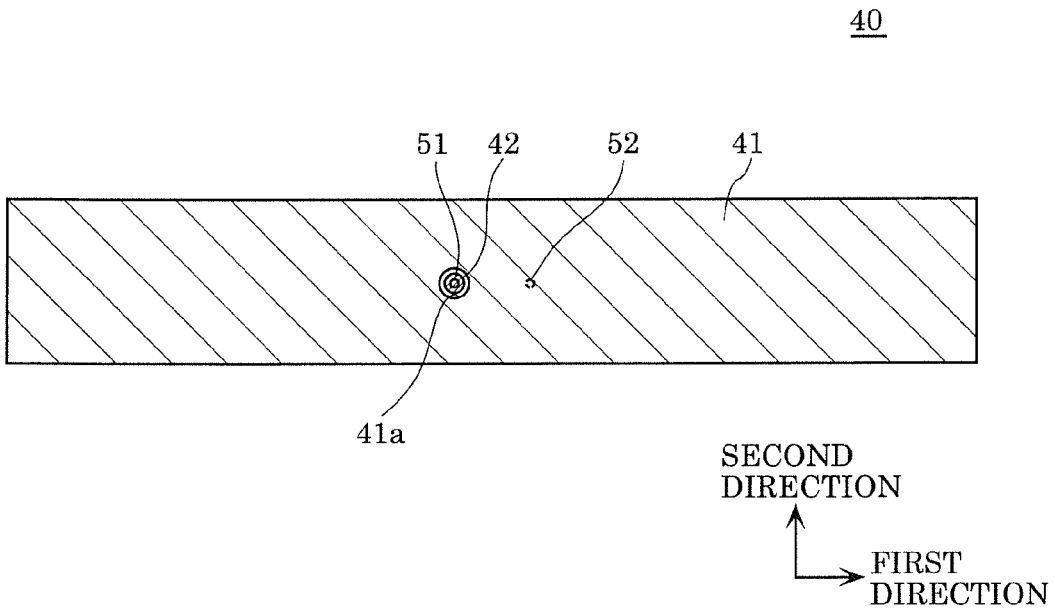
FIG. 5 is a top view of a third conductor layer of the printed wiring board according to Embodiment 1.

Printed wiring board 11 is a board that includes conductors constituting the antenna. With reference to FIG. 2 through FIG. 5, a detailed structure of printed wiring board 11 will be described. FIG. 2 is a cross-sectional view of printed wiring board 11 according to the present embodiment. FIG. 2 shows a cross-section of printed wiring board 11 taken along II-II line shown in FIG. 1. FIG. 3, FIG. 4, and FIG. 5 are top views of first conductor layer 20, second conductor layer 30, and third conductor layer 40, respectively, of printed wiring board 11 according to the present embodiment. Note that FIG. 3 also shows first dielectric layer 61 together with first conductor layer 20.

As shown in FIG. 2, printed wiring board 11 includes first conductor layer 20, second conductor layer 30, first dielectric layer 61, third conductor layer 40, second dielectric layer 62, first through-hole electrode 51, and second through-hole electrode 52.

As shown in FIG. 3, first conductor layer 20 includes feed element 21, first grounding element 22, and parasitic element 23. First conductor layer 20 according to the present embodiment is a conductor film formed by metallic foil such as copper foil.

Feed element 21 is an antenna conductor that is supplied with power via coaxial cable 90, first through-hole electrode 51 and so forth. Feed element 21 according to the present embodiment is a long-length conductor that extends in a first direction that is the longitudinal direction of printed wiring board 11. That end of feed element 21 which is close to first grounding element 22 (i.e., the end close to first gap 24 described later) is connected to first through-hole electrode 51.

First grounding element 22 is a conductor that is located in a position next to feed element 21 in the first direction via first gap 24, and grounded. First grounding element 22 according to the present embodiment is a long-length conductor that extends in the first direction. First grounding element 22 is grounded via second through-hole electrode 52. That end of first grounding element 22 which is close to feed element 21, i.e., the end close to first gap 24, is connected to second through-hole electrode 52.

Parasitic element 23 is a conductor that is located along feed element 21 and first grounding element 22 and insulated from feed element 21 and first grounding element 22. Parasitic element 23 according to the present embodiment is a long-length conductor that extends in the first direction along feed element 21 and first grounding element 22. As shown in FIG. 2 and FIG. 3, parasitic element 23 extends in the first direction from that end of feed element 21 which is further from first gap 24 to that end of first grounding element 22 which is further from first gap 24. Parasitic element 23 may be longer in the first direction than that end of feed element 21 which is further from first gap 24. Parasitic element 23 may also be longer in the first direction than that end of first grounding element 22 which is further from first gap 24.

Second conductor layer 30 is a conductor layer that is located opposite to first conductor layer 20 and serves as an AMC. As shown in FIG. 4, second conductor layer 30 includes floating element 31, second grounding element 32, first intermediate element 33, and second intermediate element 34. Second conductor layer 30 according to the present embodiment is a conductor film formed by metallic foil such as copper foil.

Floating element 31 is a conductor that is located opposite to feed element 21 and parasitic element 23, and insulated from first conductor layer 20. Floating element 31 according to the present embodiment is a long-length conductor that extends in the first direction. Floating element 31 is penetrated by first through-hole electrode 51. Floating element 31 includes opening 31*a* that is formed in a portion penetrated by first through-hole electrode 51.

Second grounding element 32 is a conductor located in a position that is opposite to first grounding element 22 and parasitic element 23 and next to floating element 31 in the first direction via second gap 37, and grounded. Second grounding element 32 according to the present embodiment is a long-length conductor that is grounded via second through-hole electrode 52 and that extends in the first direction. Floating element 31 and second grounding element 32 form a shape that is asymmetric with respect to second gap 37. In a plan view of first conductor layer 20, first gap 24 at least partially overlaps second gap 37.

First intermediate element 33 is a conductor that is located, in second gap 37, opposite to parasitic element 23 of first conductor layer 20, and that extends in a second direction that intersects the first direction. First intermediate element 33 is located in a position next to second grounding element 32 in the first direction via first intermediate gap 35. First intermediate element 33 is insulated from floating element 31. First intermediate element 33 may also be insulated from second grounding element 32.

Second intermediate element 34 is a conductor that is located, in second gap 37, next to first intermediate element 33 in the second direction via third gap 38, and that extends in the second direction. Second intermediate element 34 is located in a position next to second grounding element 32 in the first direction via second intermediate gap 36. Second intermediate element 34 is insulated from floating element 31. Second intermediate element 34 may also be insulated from second grounding element 32. In a plan view of first conductor layer 20, third gap 38 is located in a position that at least partially overlaps at least one of feed element 21, first grounding element 22, and first gap 24 (see FIG. 2 through FIG. 4).

Third conductor layer 40 is a conductor layer that is located opposite to second conductor layer 30. As shown in FIG. 5, third conductor layer 40 includes third grounding element 41 and pad electrode 42. Third conductor layer 40 according to the present embodiment is a conductor film formed by metallic foil such as copper foil.

Third grounding element 41 is a conductor that is located opposite to second conductor layer 30, and grounded. Third grounding element 41 is located opposite to floating element 31, second grounding element 32, first intermediate element 33, and second intermediate element 34. Third grounding element 41 is connected to second through-hole electrode 52. Third grounding element 41 has opening 41*a*, within which pad electrode 42 is located. Third grounding element 41 is connected to an external conductor of coaxial cable 90.

Pad electrode 42 is an electrode that is located inside opening 41*a* formed in third grounding element 41, and insulated from third grounding element 41. Pad electrode 42 is connected to first through-hole electrode 51. Pad electrode 42 is connected to an internal conductor of coaxial cable 90.

As shown in FIG. 2, first dielectric layer 61 is a dielectric layer that is located between first conductor layer 20 and second conductor layer 30. First dielectric layer 61 is formed, for example, of a dielectric material such as glass epoxy. First dielectric layer 61 has through-holes through which first through-hole electrode 51 and second through-hole electrode 52 pass. First dielectric layer 61 according to the present embodiment has a long, substantially rectangular shape that extends in the first direction. As shown in FIG. 3, the entirety of first conductor layer 20 is located on one of the main surfaces of first dielectric layer 61. The entirety of second conductor layer 30 is located on the other of the main surfaces of first dielectric layer 61. Note that a resist film covering first conductor layer 20 may be located on that main surface of first dielectric layer 61 which is at the side of first conductor layer 20.

As shown in FIG. 2, second dielectric layer 62 is a dielectric layer that is located between second conductor layer 30 and third conductor layer 40. Second dielectric layer 62 is formed, for example, of a dielectric material such as glass epoxy. Second dielectric layer 62 has through-holes through which first through-hole electrode 51 and second through-hole electrode 52 pass. Second dielectric layer 62 according to the present embodiment has a long, substantially rectangular shape that extends in the first direction, as in the case of first dielectric layer 61. The entirety of second conductor layer 30 is located on one of the main surfaces of second dielectric layer 62. The entirety of third conductor layer 40 is located on the other of the main surfaces of second dielectric layer 62. Note that a resist film covering third conductor layer 40 may be located on that main surface of second dielectric layer 62 which is at the side of third conductor layer 40. Also, second dielectric layer 62 may be integrated with first dielectric layer 61. When third conductor layer 40 is covered with a resist film, the resist film may be removed from a portion of pad electrode 42 and from that portion of third grounding element 41 at which second through-hole electrode 52 is connected. This enables third grounding element 41 and pad electrode 42 to be connected to the external conductor and the internal conductor of coaxial cable 90, respectively.

Floating element 31 and second grounding element 32 form a shape that is asymmetric with respect to second gap 37 as described above. More specifically, second grounding element 32 may be shorter in the first direction than floating element 31. In this case, the length of that portion in third conductor layer 40 which is opposite to second grounding element 32 may be shorter in the first direction. Similarly, the lengths of those portions of first dielectric layer 61 and second dielectric layer 62 which are opposite to second grounding element 32 may be shorter in the first direction. Second grounding element 32 having a shorter length in the first direction than the length of floating element 31 in the first direction as described above results in a reduced length in the first direction of the entire antenna device. Stated differently, the antenna device can be further downsized. This consequently provides a higher flexibility in placing the antenna device. Such structure achieves a similar effect that is achieved by the structure where the length of second grounding element 32 in the first direction is equivalent to the length of floating element 31 in the first direction.

[1-2. Frequency Characteristics]

Figure 6:
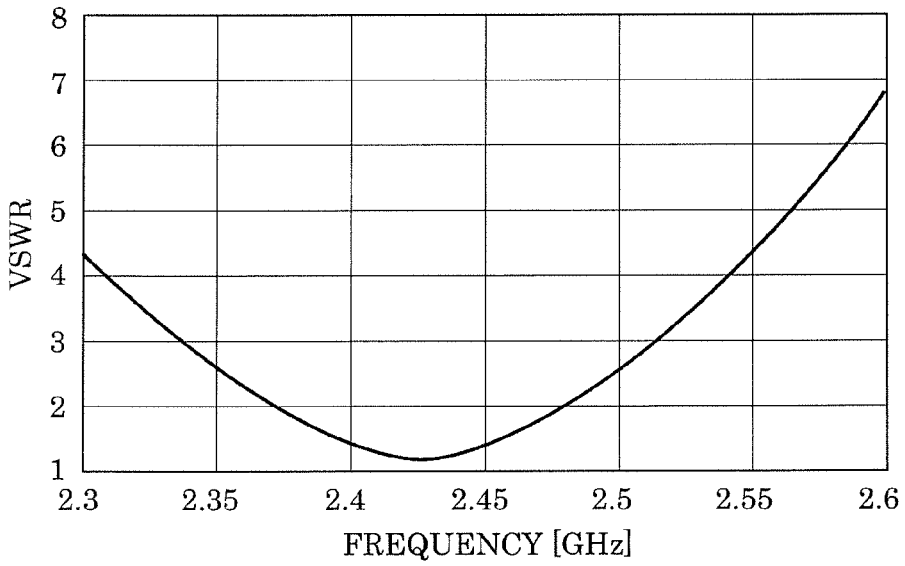
FIG. 6 is a graph showing the frequency dependence of the voltage standing wave ratio (VSWR) of the antenna device according to Embodiment 1.

With reference to FIG. 6, the following describes the frequency characteristics of antenna device 10 according to the present embodiment. FIG. 6 is a graph showing the frequency dependence of the voltage standing wave ratio (VSWR) of antenna device 10 according to the present embodiment. FIG. 6 shows the frequency dependence actually measured.

As shown in FIG. 6, antenna device 10 according to the present embodiment achieves the VSWR of less than 2 in the 2.4 GHz band (between 2.4 GHz and 2.475 GHz, inclusive), which is the frequency band of the intended use. As described above, antenna device 10 according to the present embodiment is capable of widening the frequency band that can be used.

[1-3. Variations]

An exemplary configuration of antenna device 10 according to the present embodiment has been described above, but the configuration of the antenna device according to the present embodiment is not limited to such exemplary configuration. The following describes variations of the antenna device according to the present embodiment.

[1-3-1. Variation 1]

Figure 7A:
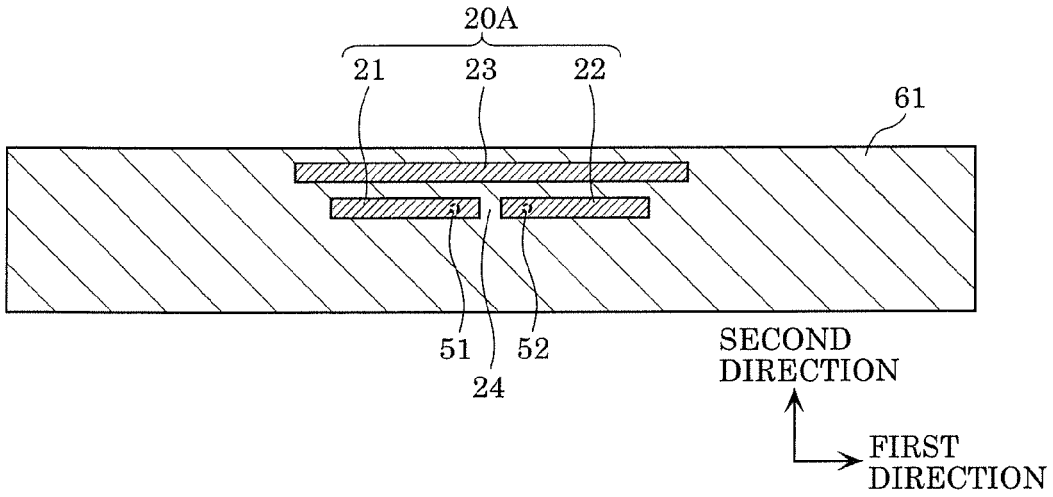
FIG. 7A is a top view of a first conductor layer of the antenna device according to Variation 1 of Embodiment 1.
Figure 7B:
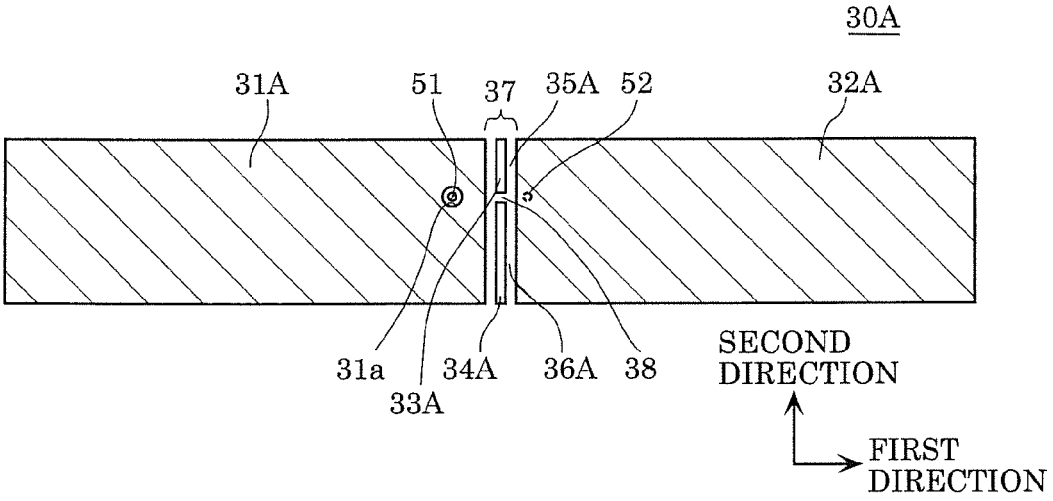
FIG. 7B is a top view of a second conductor layer of the antenna device according to Variation 1 of Embodiment 1.
Figure 7C:
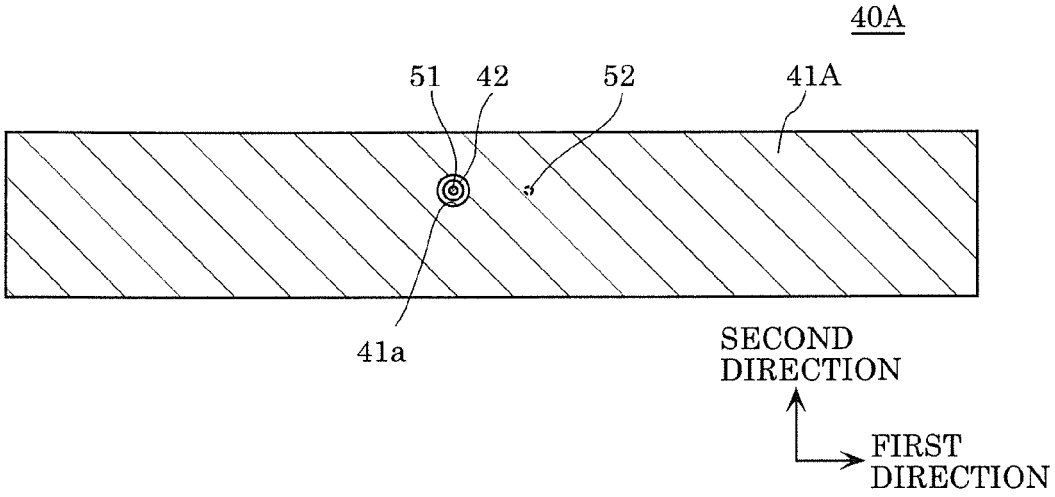
FIG. 7C is a top view of a third conductor layer of the antenna device according to Variation 1 of Embodiment 1.

An antenna device according to Variation 1 of the present embodiment will be described. The antenna device according to the present variation is mainly different from antenna device 10 according to Embodiment 1 in the arrangement of the first conductor layer. With reference to FIG. 7A through FIG. 7C, the configuration of the antenna device according to the present variation will be described, focusing on the difference from antenna device 10 according to Embodiment 1.

FIG. 7A, FIG. 7B, and FIG. 7C are top views of first conductor layer 20A, second conductor layer 30A, and third conductor layer 40A, respectively, of the antenna device according to the present variation. Note that FIG. 7A also shows first dielectric layer 61 together with first conductor layer 20A. As shown in FIG. 7A, first conductor layer 20A of the antenna device according to the present variation includes feed element 21, first grounding element 22, and parasitic element 23, as in the case of first conductor layer 20 according to Embodiment 1. First conductor layer 20A according to the present variation is located in a position, in first dielectric layer 61, which has been shifted in the second direction with respect to first conductor layer 20 according to Embodiment 1. First conductor layer 20A is in a position that has been shifted closer to that end of first dielectric layer 61 which is close to parasitic element 23 than first conductor layer 20 according to Embodiment 1. Accordingly, the positions of first through-hole electrode 51 and second through-hole electrode 52 in the second direction have been shifted in the second direction with respect to the positions of first through-hole electrode 51 and second through-hole electrode 52 of antenna device 10 according to Embodiment 1.

The structures of second conductor layer 30A and third conductor layer 40A change in accordance with the position of first conductor layer 20A. As shown in FIG. 7B, second conductor layer 30A includes floating element 31A, second grounding element 32A, first intermediate element 33A, and second intermediate element 34A, as in the case of second conductor layer 30 according to Embodiment 1. First intermediate element 33A is located next to second grounding element 32A in the first direction via first intermediate gap 35A. Second intermediate element 34A is located next to second grounding element 32A in the first direction via second intermediate gap 36A. Third gap 38 located between first intermediate element 33A and second intermediate element 34A is in a position that has been shifted in the second direction with respect to the position of third gap 38 according to Embodiment 1. The same is applicable to the position of opening 31*a* in floating element 31A.

Third conductor layer 40A shown in FIG. 7C includes third grounding element 41A and pad electrode 42 as in the case of third conductor layer 40 according to Embodiment 1. As shown in FIG. 7C, opening 41*a*, pad electrode 42, and second through-hole electrode 52 in third grounding element 41A are in positions shifted in the second direction with respect to the positions of those according to Embodiment 1.

The antenna device according to the present variation achieves an effect similar to that of antenna device 10 according to Embodiment 1. The antenna device according to the present variation is more capable of increasing the radiation intensity in the second direction than antenna device 10 according to Embodiment 1.

[1-3-2. Variation 2]

Figure 8:
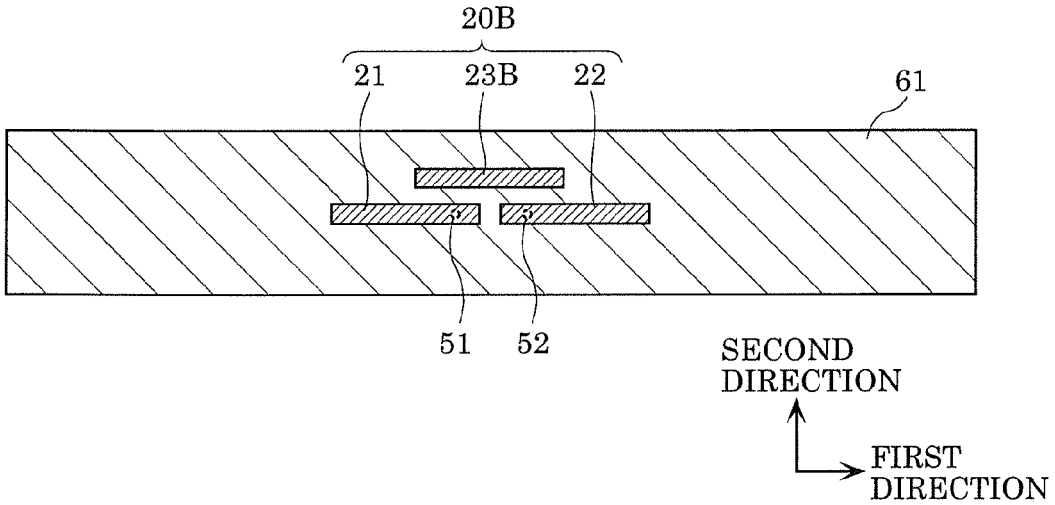
FIG. 8 is a top view of a first conductor layer of the antenna device according to Variation 2 of Embodiment 1.

An antenna device according to Variation 2 of the present embodiment will be described. The antenna device according to the present variation is different from antenna device 10 according to Embodiment 1 in the structure of the first conductor layer. With reference to FIG. 8, the configuration of the antenna device according to the present variation will be described, focusing on the difference from antenna device 10 according to Embodiment 1.

FIG. 8 is a top view of first conductor layer 20B of the antenna device according to the present variation. Note that FIG. 8 also shows first dielectric layer 61 together with first conductor layer 20B. As shown in FIG. 8, first conductor layer 20B includes feed element 21, first grounding element 22, and parasitic element 23B, as in the case of first conductor layer 20 according to Embodiment 1. Parasitic element 23B of first conductor layer 20B according to the present variation is shorter than parasitic element 23 according to Embodiment 1 in the length in the first direction. The antenna device including first conductor layer 20B with the above configuration achieves an effect similar to that of antenna device 10 according to Embodiment 1.

[1-3-3. Variation 3]

Figure 9:
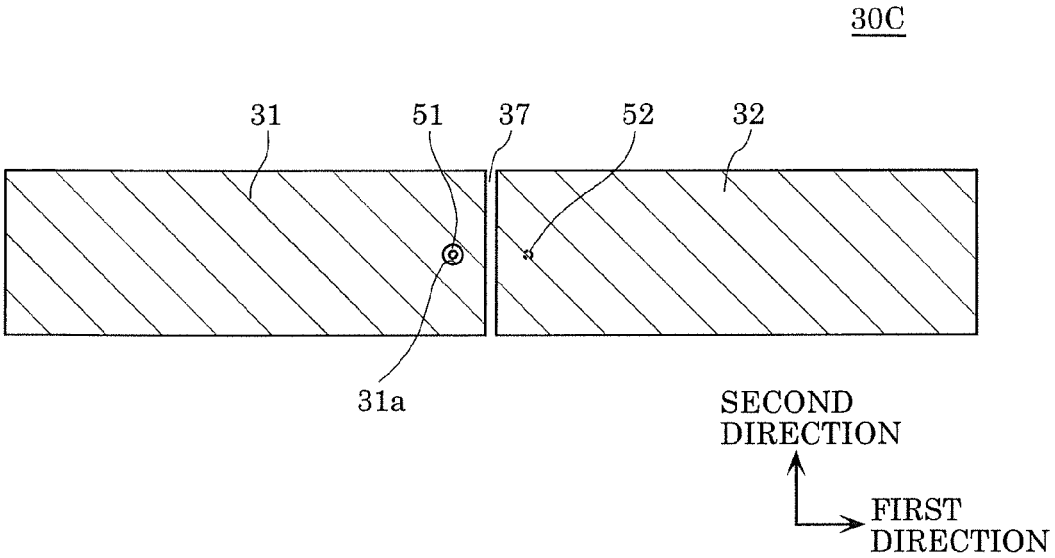
FIG. 9 is a top view of a second conductor layer of the antenna device according to Variation 3 of Embodiment 1.

An antenna device according to Variation 3 of the present embodiment will be described. The antenna device according to the present variation is different from antenna device 10 according to Embodiment 1 in the structure of the second conductor layer. With reference to FIG. 9, the configuration of the antenna device according to the present variation will be described, focusing on the difference from antenna device 10 according to Embodiment 1.

FIG. 9 is a top view of second conductor layer 30C of the antenna device according to the present variation. As shown in FIG. 9, second conductor layer 30C according to the present variation is different from second conductor layer 30 according to Embodiment 1 in that second conductor layer 30C does not include first intermediate element 33 and second intermediate element 34. The antenna device including second conductor layer 30C with the above structure achieves an effect similar to that of antenna device 10 according to Embodiment 1. Note, however, that antenna device 10 according to Embodiment 1 that includes second conductor layer 30 having first intermediate element 33 and second intermediate element 34 is capable of further widening the frequency band that can be used.

[1-3-4. Variation 4]

Figure 10:
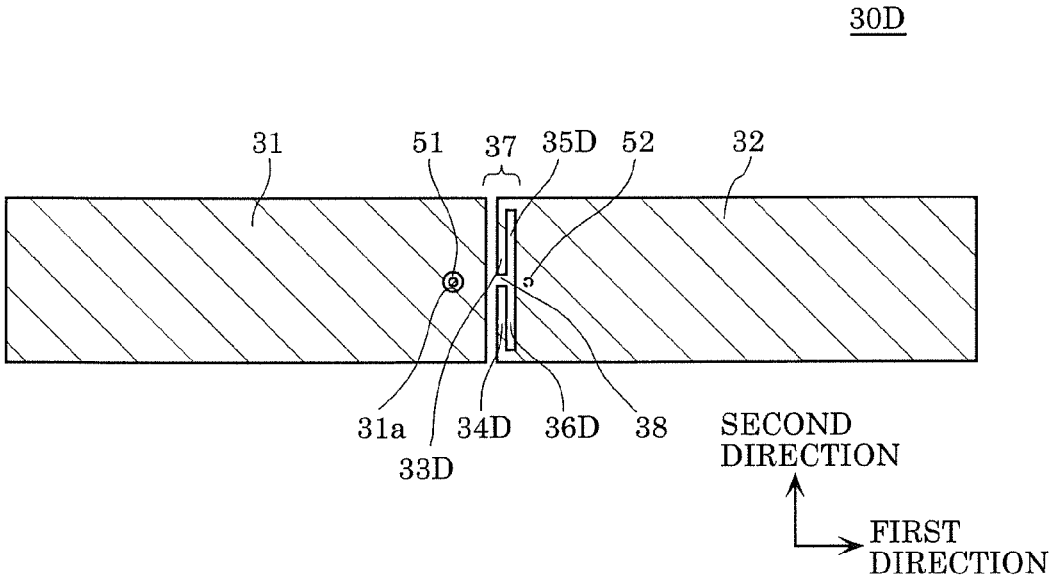
FIG. 10 is a top view of a second conductor layer of the antenna device according to Variation 4 of Embodiment 1.

An antenna device according to Variation 4 of the present embodiment will be described. The antenna device according to the present variation is different from antenna device 10 according to Embodiment 1 in the structure of the second conductor layer. With reference to FIG. 10, the configuration of the antenna device according to the present variation will be described, focusing on the difference from antenna device 10 according to Embodiment 1.

FIG. 10 is a top view of second conductor layer 30D of the antenna device according to the present variation. As shown in FIG. 10, second conductor layer 30D according to the present variation includes floating element 31, second grounding element 32, first intermediate element 33D, and second intermediate element 34D.

First intermediate element 33D is located next to second grounding element 32 in the first direction via first intermediate gap 35D. First intermediate element 33D is connected to second grounding element 32 at that end which is further from third gap 38.

Second intermediate element 34D is located next to second grounding element 32 in the first direction via second intermediate gap 36D. Second intermediate element 34D is connected to second grounding element 32 at that end which is further from third gap 38.

The antenna device including second conductor layer 30D with the above structure achieves an effect similar to that of antenna device 10 according to Embodiment 1.

[1-3-5. Variation 5]

Figure 11:
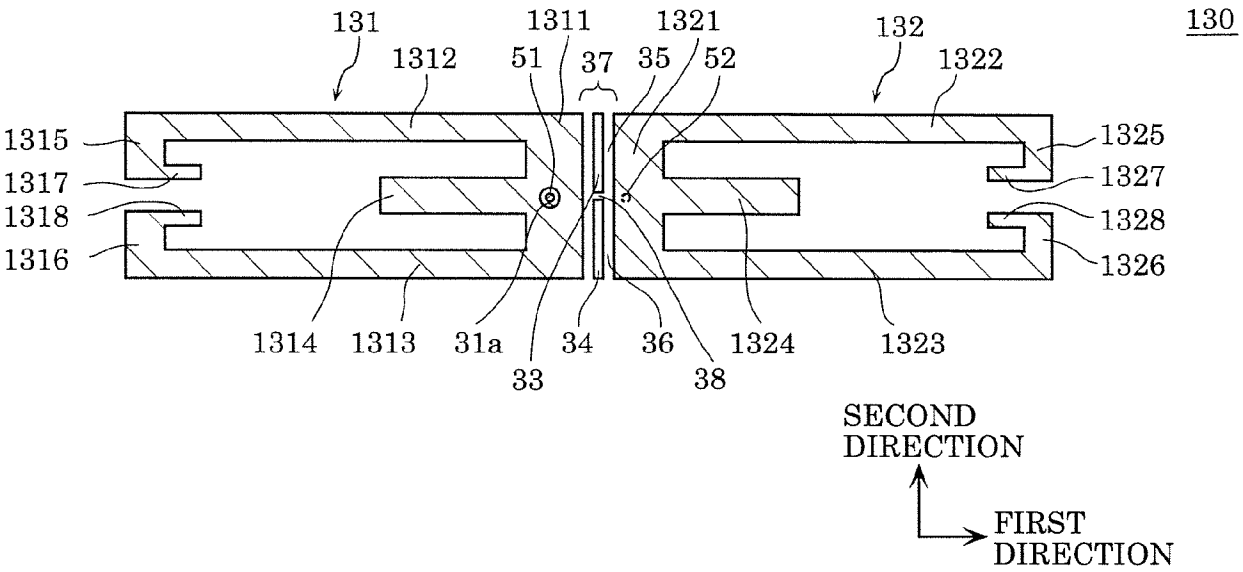
FIG. 11 is a top view of a second conductor layer of the antenna device according to Variation 5 of Embodiment 1.

An antenna device according to Variation 5 of the present embodiment will be described. The antenna device according to the present variation is different from antenna device 10 according to Embodiment 1 in the structure of the second conductor layer. With reference to FIG. 11, the configuration of the antenna device according to the present variation will be described, focusing on the difference from antenna device 10 according to Embodiment 1.

FIG. 11 is a top view of second conductor layer 130 of the antenna device according to the present variation. As shown in FIG. 11, second conductor layer 130 according to the present variation includes floating element 131, second grounding element 132, first intermediate element 33, and second intermediate element 34. Second conductor layer 130 according to the present variation is different from second conductor layer 30 according to Embodiment 1 in the shapes of floating element 131 and second grounding element 132.

The shape of the external edge of floating element 131 is substantially rectangular, as in the case of floating element 31 according to Embodiment 1, but its internal region is hollowed out. More specifically, floating element 131 includes floating main portion 1311, first floating extending portion 1312, second floating extending portion 1313, floating tongue-like portion 1314, first floating bending portion 1315, second floating bending portion 1316, first floating inward portion 1317, and second floating inward portion 1318.

Floating main portion 1311, which is the main portion of floating element 131, extends in the second direction along second gap 37.

First floating extending portion 1312 is a long-length portion that extends in the first direction from one of the ends of floating main portion 1311. First floating extending portion 1312 extends from that end of floating main portion 1311 which is located closer to parasitic element 23 toward the direction away from second gap 37 (the leftward direction in FIG. 11).

Second floating extending portion 1313 is a long-length portion that extends in the first direction from the other end of floating main portion 1311. Second floating extending portion 1313 extends from that end of floating main portion 1311 which is located closer to feed element 21 toward the direction away from second gap 37 (the leftward direction in FIG. 11). Second floating extending portion 1313 and first floating extending portion 1312 according to the present embodiment have substantially equal widths (i.e., the dimensions in the second direction) and substantially equal lengths (i.e., the dimensions in the first direction).

Floating tongue-like portion 1314 is a long, tongue-like portion that extends in the first direction from floating main portion 1311. Floating tongue-like portion 1314 is located in a position that is between first floating extending portion 1312 and second floating extending portion 1313 and opposite to feed element 21 of first conductor layer 20. Floating tongue-like portion 1314 has a width (i.e., the dimension in the second direction) that is greater than the width, for example, of feed element 21. Feed element 21 may be located within the region of floating main portion 1311 or floating tongue-like portion 1314 in a plan view of first conductor layer 20. In this case, the sum of the dimension of floating main portion 1311 in the first direction and the dimension of floating tongue-like portion 1314 in the first direction is greater than the length of feed element 21 (i.e., the dimension in the first direction).

First floating bending portion 1315 is a portion that extends in the second direction from that end of first floating extending portion 1312 which is further from floating main portion 1311. First floating bending portion 1315 extends from first floating extending portion 1312 toward the direction approaching second floating extending portion 1313.

Second floating bending portion 1316 is a portion that extends in the second direction from that end of second floating extending portion 1313 which is further from floating main portion 1311. Second floating bending portion 1316 extends from second floating extending portion 1313 toward the direction approaching first floating extending portion 1312. Second floating bending portion 1316 and first floating bending portion 1315 according to the present embodiment have substantially equal widths (i.e., the dimensions in the first direction) and substantially equal lengths (i.e., the dimensions in the second direction).

First floating inward portion 1317 is a portion that extends in the first direction from that end of first floating bending portion 1315 which is further from first floating extending portion 1312. First floating inward portion 1317 extends from first floating bending portion 1315 toward the direction approaching floating main portion 1311.

Second floating inward portion 1318 is a portion that extends in the first direction from that end of second floating bending portion 1316 which is further from second floating extending portion 1313. Second floating inward portion 1318 extends from second floating bending portion 1316 toward the direction approaching floating main portion 1311. Second floating inward portion 1318 and first floating inward portion 1317 according to the present embodiment have substantially equal widths (i.e., the dimensions in the second direction) and substantially equal lengths (i.e., the dimensions in the first direction).

The shape of the external edge of second grounding element 132 is substantially rectangular, as in the case of second grounding element 32 according to Embodiment 1, but its internal region is hollowed out. More specifically, second grounding element 132 includes grounding main portion 1321, first grounding extending portion 1322, second grounding extending portion 1323, grounding tongue-like portion 1324, first grounding bending portion 1325, second grounding bending portion 1326, first grounding inward portion 1327, and second grounding inward portion 1328.

Grounding main portion 1321, which is the main portion of second grounding element 132, extends in the second direction along second gap 37.

First grounding extending portion 1322 is a long-length portion that extends in the first direction from one of the ends of grounding main portion 1321. First grounding extending portion 1322 extends from that end of grounding main portion 1321 which is located closer to parasitic element 23 toward the direction away from second gap 37 (the leftward direction in FIG. 11).

Second grounding extending portion 1323 is a long-length portion that extends in the first direction from the other end of grounding main portion 1321. Second grounding extending portion 1323 extends from that end of grounding main portion 1321 which is located closer to first grounding element 22 toward the direction away from second gap 37 (the leftward direction in FIG. 11). Second grounding extending portion 1323 and first grounding extending portion 1322 according to the present embodiment have substantially equal widths (i.e., the dimensions in the second direction) and substantially equal lengths (i.e., the dimensions in the first direction).

Grounding tongue-like portion 1324 is a long, tongue-like portion that extends in the first direction from grounding main portion 1321. Grounding tongue-like portion 1324 is located in a position that is between first grounding extending portion 1322 and second grounding extending portion 1323 and opposite to first grounding element 22 of first conductor layer 20. Grounding tongue-like portion 1324 has a width (i.e., the dimension in the second direction) that is greater than the width, for example, of first grounding element 22. First grounding element 22 may be located within the region of grounding main portion 1321 or grounding tongue-like portion 1324 in a plan view of first conductor layer 20. In this case, the sum of the dimension of grounding main portion 1321 in the first direction and the dimension of grounding tongue-like portion 1324 in the first direction is greater than the length of first grounding element 22 (i.e., the dimension in the first direction).

First grounding bending portion 1325 is a portion that extends in the second direction from that end of first grounding extending portion 1322 which is further from grounding main portion 1321. First grounding bending portion 1325 extends from first grounding extending portion 1322 toward the direction approaching second grounding extending portion 1323.

Second grounding bending portion 1326 is a portion that extends in the second direction from that end of second grounding extending portion 1323 which is further from grounding main portion 1321. Second grounding bending portion 1326 extends from second grounding extending portion 1323 toward the direction approaching first grounding extending portion 1322. Second grounding bending portion 1326 and first grounding bending portion 1325 according to the present embodiment have substantially equal widths (i.e., the dimensions in the first direction) and substantially equal lengths (i.e., the dimensions in the second direction).

First grounding inward portion 1327 is a portion that extends in the first direction from that end of first grounding bending portion 1325 which is further from first grounding extending portion 1322. First grounding inward portion 1327 extends from first grounding bending portion 1325 toward the direction approaching grounding main portion 1321.

Second grounding inward portion 1328 is a portion that extends in the first direction from that end of second grounding bending portion 1326 which is further from second grounding extending portion 1323. Second grounding inward portion 1328 extends from second grounding bending portion 1326 toward the direction approaching grounding main portion 1321. Second grounding inward portion 1328 and first grounding inward portion 1327 according to the present embodiment have substantially equal widths (i.e., the dimensions in the second direction) and substantially equal lengths (i.e., the dimensions in the first direction).

Second conductor layer 130 with the above structure enables floating element 131 and second grounding element 132 of second conductor layer 130 according to the present variation to increase the electrical lengths without the enlargement of their dimensions. For example, floating element 31 according to Embodiment 1 has the electrical length that is substantially equal to the length of floating element 31 in the first direction. Meanwhile, floating element 131 according to the present variation has the electrical length that is substantially equal to the sum of the length of floating tongue-like portion 1314, the length of first floating extending portion 1312, the length of first floating bending portion 1315, and the length of first floating inward portion 1317. Stated differently, each of floating element 131 and second grounding element 132 according to the present variation has the electrical length that is longer than the length per se. Consequently, the present variation enables second conductor layer 130 to have a smaller dimension, especially the dimension in the longitude direction (i.e., the first direction), than that of second conductor layer 30 according to Embodiment 1. For example, the present variation is capable of reducing the dimensions of floating element 131 and second grounding element 132 to some 22 mm and 21.5 mm, respectively. The present variation thus achieves the printed wiring board of the antenna device having the length of some 45 mm and the width of some 9.5 mm.

The antenna device according to the present variation also achieves the effect of further reducing the size of the antenna device as described above, in addition to a similar effect achieved by antenna device 10 according to Embodiment 1.

Floating element 131 and second grounding element 132 of the antenna device according to the present variation also form a shape that is asymmetric with respect to second gap 37, as in the case of the antenna device according to the present embodiment and each variation. More specifically, second grounding element 132 may be shorter than floating element 131 in the length in the first direction. In this case, the length in the first direction of that portion in third conductor layer 40 which is opposite to second grounding element 132 may also be reduced. Similarly, the lengths of those portions in the first direction in first dielectric layer 61 and second dielectric layer 62 which are opposite to second grounding element 132 may also be reduced. Second grounding element 132 having a shorter length in the first direction than the length of floating element 131 in the first direction results in a reduced length in the first direction of the entire antenna device. Stated differently, the antenna device can be further downsized. This consequently provides a higher flexibility in placing the antenna device. Such structure achieves a similar effect that is achieved by the structure where the length of second grounding element 132 in the first direction is substantially equal to the length of floating element 131 in the first direction.

To reduce the length of second grounding element 132 in the first direction, the lengths of first grounding extending portion 1322 and second grounding extending portion 1323, for example, may be reduced. Alternatively, first grounding bending portion 1325, second grounding bending portion 1326, first grounding inward portion 1327, and second grounding inward portion 1328 may shortened or removed. To achieve substantially the same characteristics as those achieved by the structure in which second grounding element 132 has a reduced length in the first direction, grounding tongue-like portion 1324 may be shortened or removed.

[1-3-6. Variation 6]

Figure 12:
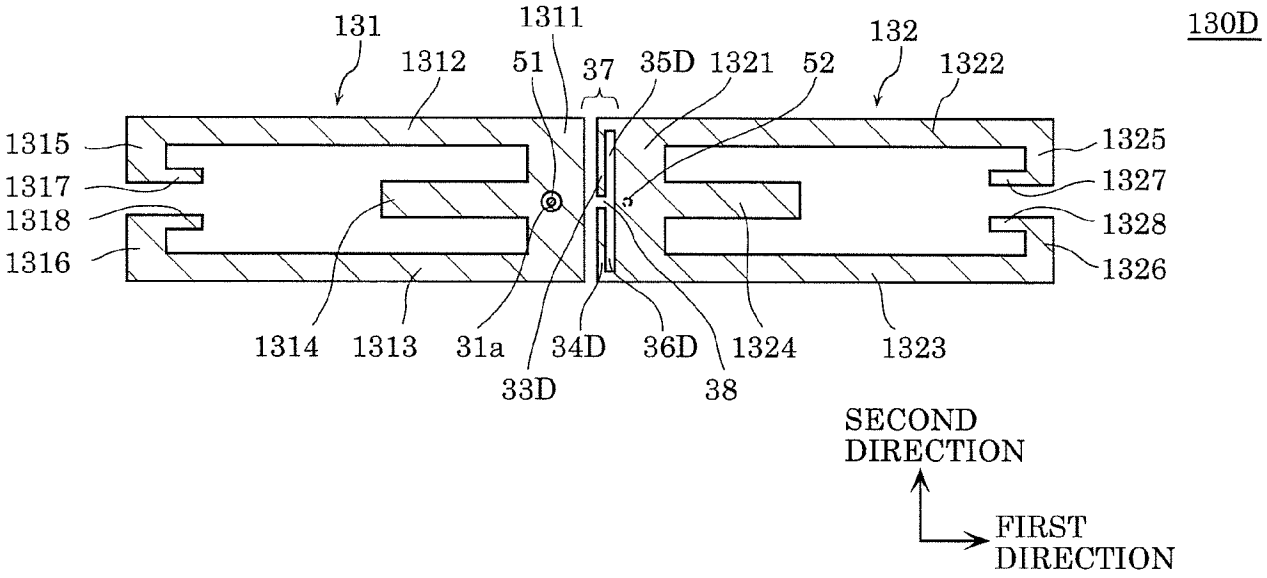
FIG. 12 is a top view of a second conductor layer of the antenna device according to Variation 6 of Embodiment 1.

An antenna device according to Variation 6 of the present embodiment will be described. The antenna device according to the present variation is different from the antenna device according to Variation 5 in the structures of the first intermediate element and the second intermediate element of the second conductor layer. With reference to FIG. 12, the configuration of the antenna device according to the present variation will be described, focusing on the difference from the antenna device according to Variation 5.

FIG. 12 is a top view of second conductor layer 130D of the antenna device according to the present variation. As shown in FIG. 12, second conductor layer 130D according to the present variation includes floating element 131, second grounding element 132, first intermediate element 33D, and second intermediate element 34D. First intermediate element 33D and second intermediate element 34D according to the present variation have structures similar to those of first intermediate element 33D and second intermediate element 34D according to Variation 4. Stated differently, first intermediate element 33D is connected to second grounding element 132 at that end which is further from third gap 38, and second intermediate element 34D is connected to second grounding element 132 at that end which is further from third gap 38.

The antenna device including second conductor layer 130D with the above structure achieves an effect similar to that of the antenna device according to Variation 5.

[1-3-7. Variation 7]

Figure 13:
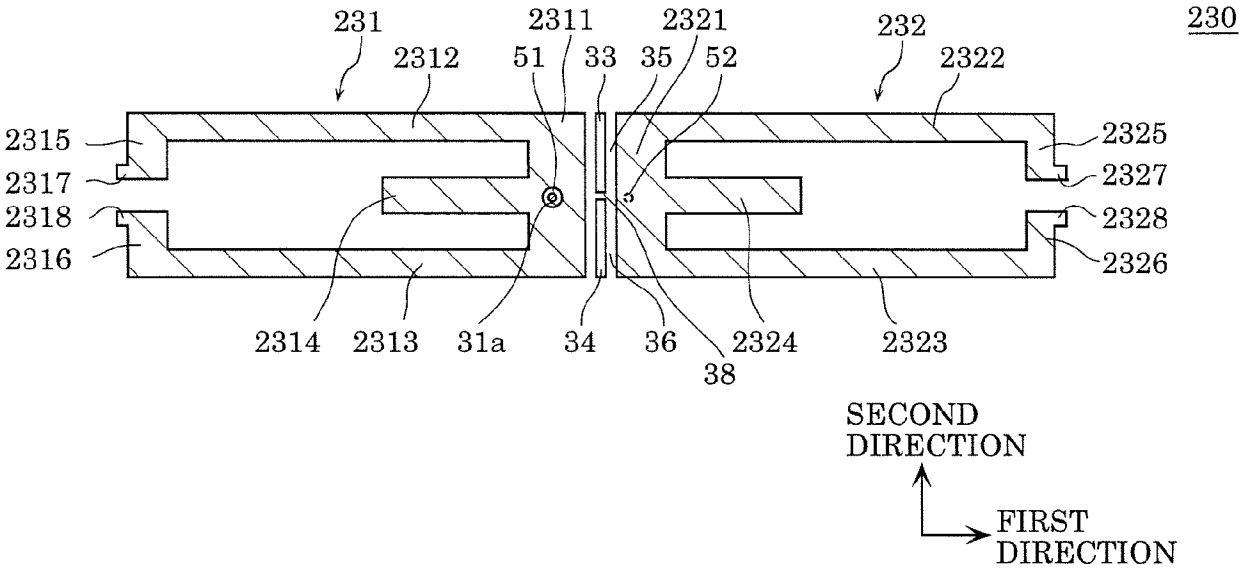
FIG. 13 is a top view of a second conductor layer of the antenna device according to Variation 7 of Embodiment 1.

An antenna device according to Variation 7 of the present embodiment will be described. The antenna device according to the present variation is different from the antenna device according to Variation 5 in the shapes of the floating element and the second grounding element of the second conductor layer. With reference to FIG. 13, the configuration of the antenna device according to the present variation will be described, focusing on the difference from the antenna device according to Variation 5.

FIG. 13 is a top view of second conductor layer 230 of the antenna device according to the present variation. As shown in FIG. 13, second conductor layer 230 of the antenna device according to the present variation includes floating element 231, second grounding element 232, first intermediate element 33, and second intermediate element 34. Second conductor layer 230 according to the present variation is different from second conductor layer 130 according to Variation 5 in the shapes of floating element 231 and second grounding element 232.

Floating element 231 includes floating main portion 2311, first floating extending portion 2312, second floating extending portion 2313, floating tongue-like portion 2314, first floating bending portion 2315, and second floating bending portion 2316, as in the case of floating element 131 according to Variation 5. Floating element 231 is different from floating element 131 according to Variation 5 in that floating element 231 includes first floating outward portion 2317 and second floating outward portion 2318.

Floating main portion 2311, first floating extending portion 2312, second floating extending portion 2313, floating tongue-like portion 2314, first floating bending portion 2315, and second floating bending portion 2316 according to the present variation have structures as those of floating main portion 1311, first floating extending portion 1312, second floating extending portion 1313, floating tongue-like portion 1314, first floating bending portion 1315, and second floating bending portion 1316, respectively, according to Variation 5.

First floating outward portion 2317 is a portion that extends in the first direction from that end of first floating bending portion 2315 which is further from first floating extending portion 2312. First floating outward portion 2317 extends from first floating bending portion 2315 outwardly, i.e., toward the direction away from floating main portion 2311.

Second floating outward portion 2318 is a portion that extends in the first direction from that end of second floating bending portion 2316 which is further from second floating extending portion 2313. Second floating outward portion 2318 extends from second floating bending portion 2316 outwardly, i.e., toward the direction away from floating main portion 2311. Second floating outward portion 2318 and first floating outward portion 2317 according to the present embodiment have substantially equal widths (i.e., the dimensions in the second direction) and substantially equal lengths (i.e., the dimensions in the first direction).

Second grounding element 232 includes grounding main portion 2321, first grounding extending portion 2322, second grounding extending portion 2323, grounding tongue-like portion 2324, first grounding bending portion 2325, and second grounding bending portion 2326, as in the case of second grounding element 132 according to Variation 5. Second grounding element 232 is different from second grounding element 132 according to Variation 5 in that second grounding element 232 includes first grounding outward portion 2327 and second grounding outward portion 2328.

Grounding main portion 2321, first grounding extending portion 2322, second grounding extending portion 2323, grounding tongue-like portion 2324, first grounding bending portion 2325, and second grounding bending portion 2326 according to the present variation have structures as those of grounding main portion 1321, first grounding extending portion 1322, second grounding extending portion 1323, grounding tongue-like portion 1324, first grounding bending portion 1325, and second grounding bending portion 1326, respectively, according to Variation 5.

First grounding outward portion 2327 is a portion that extends in the first direction from that end of first grounding bending portion 2325 which is further from first grounding extending portion 2322. First grounding outward portion 2327 extends from first grounding bending portion 2325 outwardly, i.e., toward the direction away from grounding main portion 2321.

Second grounding outward portion 2328 is a portion that extends in the first direction from that end of second grounding bending portion 2326 which is further from second grounding extending portion 2323. Second grounding outward portion 2328 extends from second grounding bending portion 2326 outwardly, i.e., toward the direction away from grounding main portion 2321. Second grounding outward portion 2328 and first grounding outward portion 2327 according to the present embodiment have substantially equal widths (i.e., the dimensions in the second direction) and substantially equal lengths (i.e., the dimensions in the first direction).

The antenna device including second conductor layer 230 with the above configuration achieves an effect similar to that of the antenna device according to Variation 5.

Floating element 231 and second grounding element 232 of the antenna device according to the present variation also form a shape that is asymmetric with respect to second gap 37, as in the case of the antenna device according to the present embodiment and each variation. More specifically, second grounding element 232 may be shorter than floating element 231 in the length in the first direction. In this case, the length of that portion in third conductor layer 40 which is opposite to second grounding element 232 may be shorter in the first direction. Similarly, the lengths of those portions in first dielectric layer 61 and second dielectric layer 62 which are opposite to second grounding element 232 may be shorter in the first direction. Second grounding element 232 having a shorter length in the first direction than the length of floating element 231 in the first direction as described above results in a reduced length in the first direction of the entire antenna device. Stated differently, the antenna device can be further downsized. This consequently provides a higher flexibility in placing the antenna device. Such structure achieves a similar effect that is achieved by the structure where the length of second grounding element 232 in the first direction is substantially equal to the length of floating element 231 in the first direction.

To reduce the length of second grounding element 232 in the first direction, the lengths of first grounding extending portion 2322 and second grounding extending portion 2323, for example, may be reduced. Alternatively, first grounding bending portion 2325, second grounding bending portion 2326, first grounding outward portion 2327, and second grounding outward portion 2328 may shortened or removed. To achieve substantially the same characteristics as those achieved by the structure in which second grounding element 232 has a reduced length in the first direction, grounding tongue-like portion 2324 may be shortened or removed.

[1-3-8. Variation 8]

Figure 14:
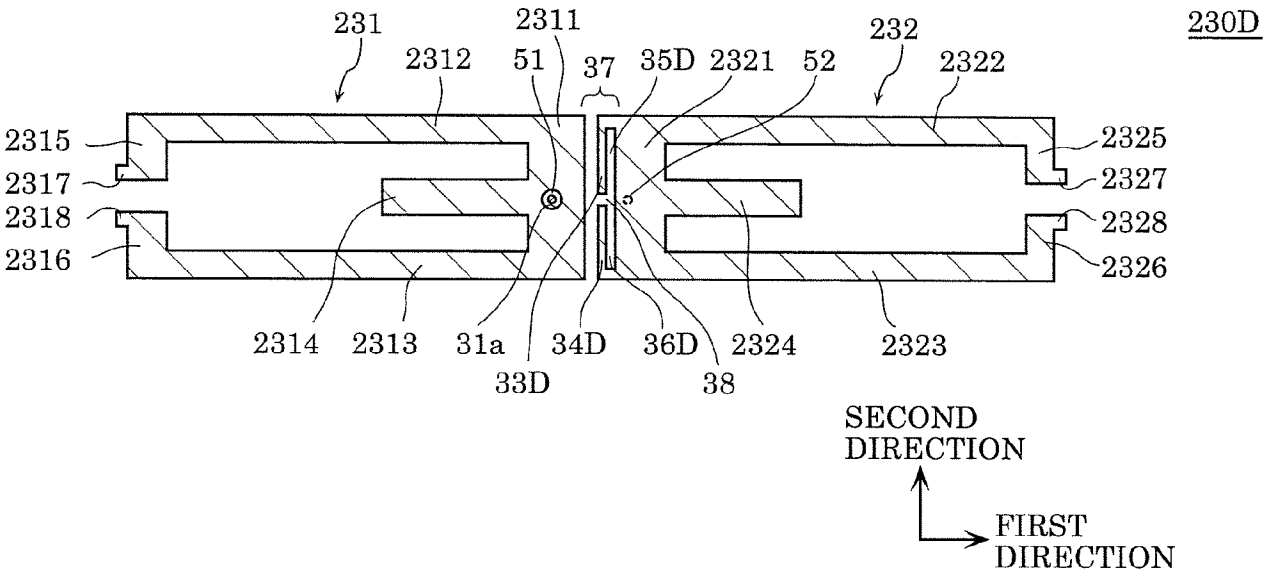
FIG. 14 is a top view of a second conductor layer of the antenna device according to Variation 8 of Embodiment 1.

An antenna device according to Variation 8 of the present embodiment will be described. The antenna device according to the present variation is different from the antenna device according to Variation 7 in the structures of the first intermediate element and the second intermediate element of the second conductor layer. With reference to FIG. 14, the configuration of the antenna device according to the present variation will be described, focusing on the difference from the antenna device according to Variation 7.

FIG. 14 is a top view of second conductor layer 230D of the antenna device according to the present variation. As shown in FIG. 14, second conductor layer 230D according to the present variation includes floating element 231, second grounding element 232, first intermediate element 33D, and second intermediate element 34D. First intermediate element 33D and second intermediate element 34D according to the present variation have structures similar to those of first intermediate element 33D and second intermediate element 34D according to Variation 4. Stated differently, first intermediate element 33D is connected to second grounding element 232 at that end which is further from third gap 38, and second intermediate element 34D is connected to second grounding element 232 at that end which is further from third gap 38.

The antenna device including second conductor layer 230D with the above configuration achieves an effect similar to that of the antenna device according to Variation 7.

[1-3-9. Variation 9]

Figure 15:
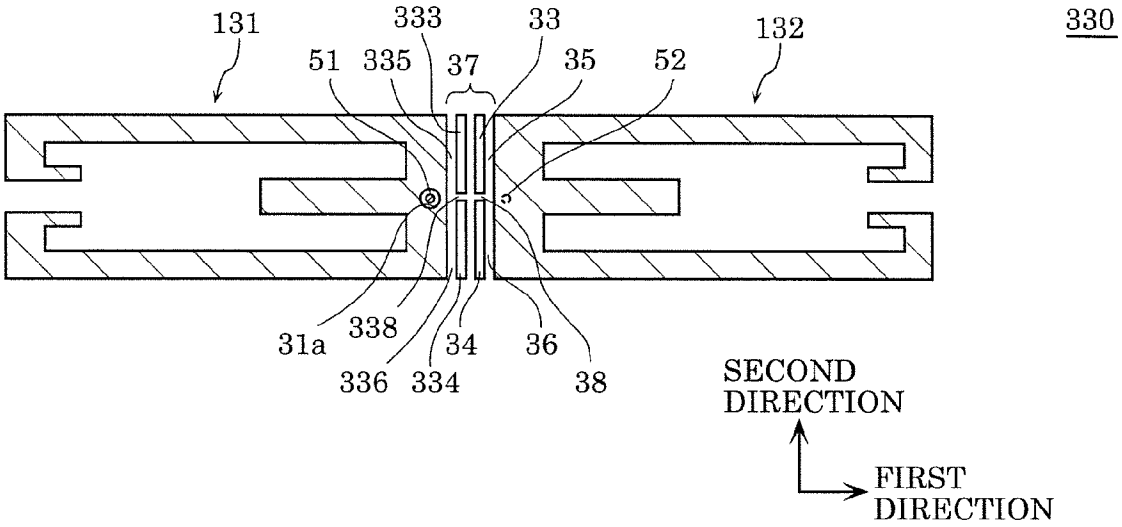
FIG. 15 is a top view of a second conductor layer of the antenna device according to Variation 9 of Embodiment 1.

An antenna device according to Variation 9 of the present embodiment will be described. The antenna device according to the present variation is different from the antenna device according to Variation 5 in the structure of the second conductor layer. With reference to FIG. 15, the configuration of the antenna device according to the present variation will be described, focusing on the difference from the antenna device according to Variation 5.

FIG. 15 is a top view of second conductor layer 330 of the antenna device according to the present variation. As shown in FIG. 15, second conductor layer 330 according to the present variation includes floating element 131, second grounding element 132, first intermediate element 33, and second intermediate element 34, as in the case of second conductor layer 130 according to Variation 5. Second conductor layer 330 according to the present variation is different from second conductor layer 130 according to Variation 5 in that second conductor layer 330 further includes third intermediate element 333 and fourth intermediate element 334.

Third intermediate element 333 is a conductor that is located, in second gap 37, opposite to parasitic element 23 of first conductor layer 20, and that extends in the second direction. Third intermediate element 333 is located in a position next to floating element 131 in the first direction via third intermediate gap 335. Stated differently, third intermediate element 333 is located between floating element 131 and first intermediate element 33 to lie along first intermediate element 33. Third intermediate element 333 according to the present embodiment has a length and a width that are substantially equal to those of first intermediate element 33. Third intermediate element 333 is insulated from second grounding element 132. Third intermediate element 333 may also be insulated from floating element 131.

Fourth intermediate element 334 is a conductor that is located, in second gap 37, next to third intermediate element 333 in the second direction via fourth gap 338, and that extends in the second direction. Fourth intermediate element 334 is located in a position next to floating element 131 in the first direction via fourth intermediate gap 336. Stated differently, fourth intermediate element 334 is located between floating element 131 and second intermediate element 34 to lie along second intermediate element 34. Fourth intermediate element 334 according to the present embodiment has a length and a width that are substantially equal to those of second intermediate element 34. Fourth intermediate element 334 is insulated from second grounding element 132. Fourth intermediate element 334 may also be insulated from floating element 131. In a plan view of first conductor layer 20, fourth gap 338 is located in a position that at least partially overlaps at least one of feed element 21, first grounding element 22, and first gap 24 (see FIG. 3 and FIG. 15).

The antenna device including second conductor layer 330 with the above configuration achieves an effect similar to that of the antenna device according to Variation 5.

[1-3-10. Variation 10]

Figure 16:
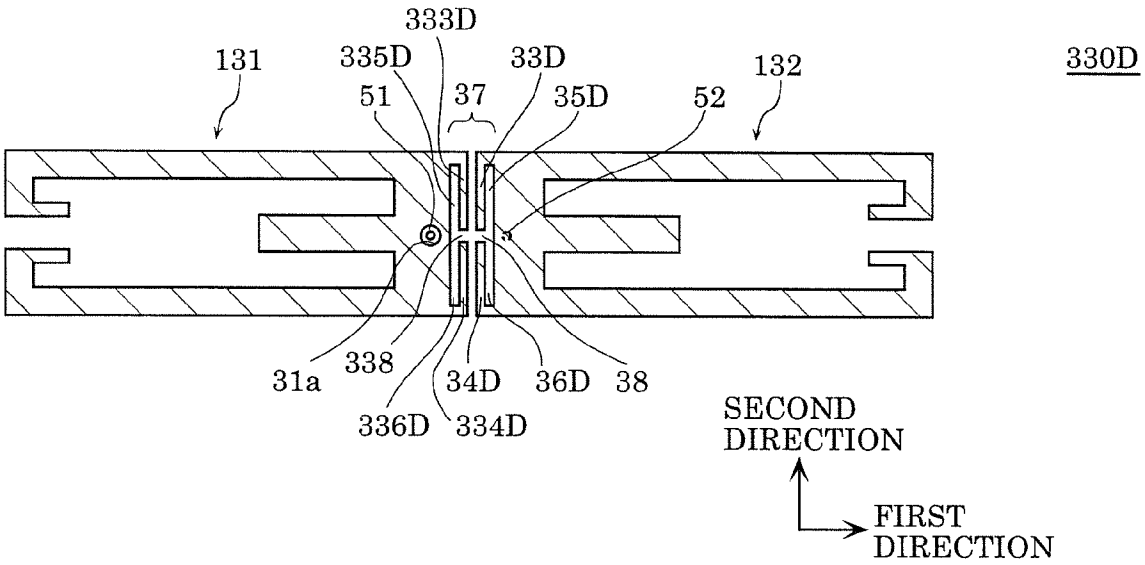
FIG. 16 is a top view of a second conductor layer of the antenna device according to Variation 10 of Embodiment 1.

An antenna device according to Variation 10 of the present embodiment will be described. The antenna device according to the present variation is different from the antenna device according to Variation 9 in the structures of the first intermediate element, the second intermediate element, the third intermediate element, and the fourth intermediate element of the second conductor layer. With reference to FIG. 16, the configuration of the antenna device according to the present variation will be described, focusing on the difference from the antenna device according to Variation 9.

FIG. 16 is a top view of second conductor layer 330D of the antenna device according to the present variation. As shown in FIG. 16, second conductor layer 330D according to the present variation includes floating element 131, second grounding element 132, first intermediate element 33D, second intermediate element 34D, third intermediate element 333D, and fourth intermediate element 334D. First intermediate element 33D and second intermediate element 34D according to the present variation have structures similar to those of first intermediate element 33D and second intermediate element 34D according to Variation 4. Stated differently, first intermediate element 33D is connected to second grounding element 132 at that end which is further from third gap 38, and second intermediate element 34D is connected to second grounding element 132 at that end which is further from third gap 38.

Third intermediate element 333D is located next to floating element 131 in the first direction via third intermediate gap 335D. Third intermediate element 333D is connected to floating element 131 at that end which is further from fourth gap 338.

Fourth intermediate element 334D is located next to floating element 131 in the first direction via fourth intermediate gap 336D. Fourth intermediate element 334D is connected to floating element 131 at that end which is further from fourth gap 338.

The antenna device including second conductor layer 330D with the above configuration achieves an effect similar to that of the antenna device according to Variation 9.

[1-3-11. Variation 11]

Figure 17:
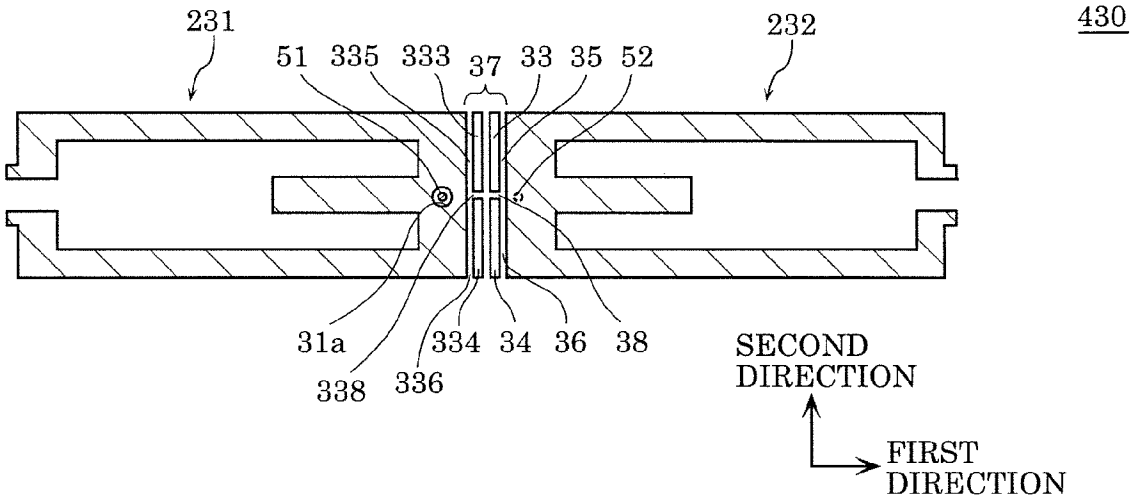
FIG. 17 is a top view of a second conductor layer of the antenna device according to Variation 11 of Embodiment 1.

An antenna device according to Variation 11 of the present embodiment will be described. The antenna device according to the present variation is different from the antenna device according to Variation 9 in the shapes of the floating element and the second grounding element of the second conductor layer. With reference to FIG. 17, the configuration of the antenna device according to the present variation will be described, focusing on the difference from the antenna device according to Variation 9.

FIG. 17 is a top view of second conductor layer 430 of the antenna device according to the present variation. As shown in FIG. 17, second conductor layer 430 according to the present variation includes floating element 231, second grounding element 232, first intermediate element 33, second intermediate element 34, third intermediate element 333, and fourth intermediate element 334, as in the case of second conductor layer 330 according to Variation 9. Second conductor layer 430 according to the present variation is different from second conductor layer 330 according to Variation 9 in that floating element 231 and second grounding element 232 have shapes similar to those of floating element 231 and second grounding element 232 according to Variation 7 shown in FIG. 13.

The antenna device including second conductor layer 430 with the above configuration achieves an effect similar to that of the antenna device according to Variation 9.

[1-3-12. Variation 12]

Figure 18:
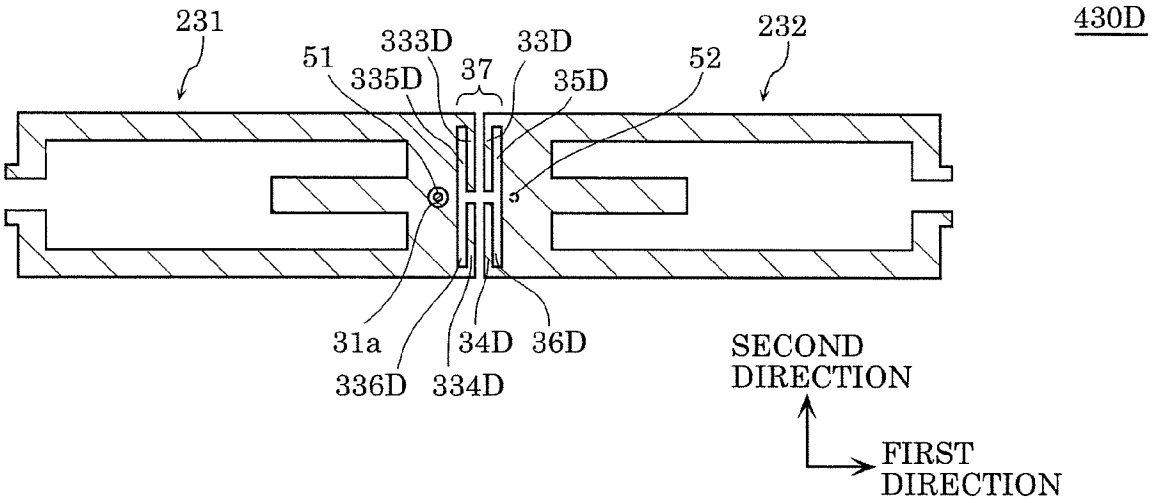
FIG. 18 is a top view of a second conductor layer of the antenna device according to Variation 12 of Embodiment 1.

An antenna device according to Variation 12 of the present embodiment will be described. The antenna device according to the present variation is different from the antenna device according to Variation 11 in the structures of the first intermediate element, the second intermediate element, the third intermediate element, and the fourth intermediate element of the second conductor layer. With reference to FIG. 18, the configuration of the antenna device according to the present variation will be described, focusing on the difference from the antenna device according to Variation 11.

FIG. 18 is a top view of second conductor layer 430D of the antenna device according to the present variation. As shown in FIG. 18, second conductor layer 430D according to the present variation includes floating element 231, second grounding element 232, first intermediate element 33D, second intermediate element 34D, third intermediate element 333D, and fourth intermediate element 334D.

First intermediate element 33D and second intermediate element 34D according to the present variation have structures similar to those of first intermediate element 33D and second intermediate element 34D according to Variation 4. Stated differently, first intermediate element 33D is connected to second grounding element 232 at that end which is further from third gap 38, and second intermediate element 34D is connected to second grounding element 232 at that end which is further from third gap 38.

Third intermediate element 333D and fourth intermediate element 334D according to the present variation have structures similar to those of third intermediate element 333D and fourth intermediate element 334D according to Variation 10. Stated differently, third intermediate element 333D is connected to floating element 231 at that end which is further from fourth gap 338, and fourth intermediate element 334D is connected to floating element 231 at that end which is further from fourth gap 338.

The antenna device including second conductor layer 430D with the above configuration achieves an effect similar to that of the antenna device according to Variation 11.

[1-3-13. Variation 13]

Figure 19:
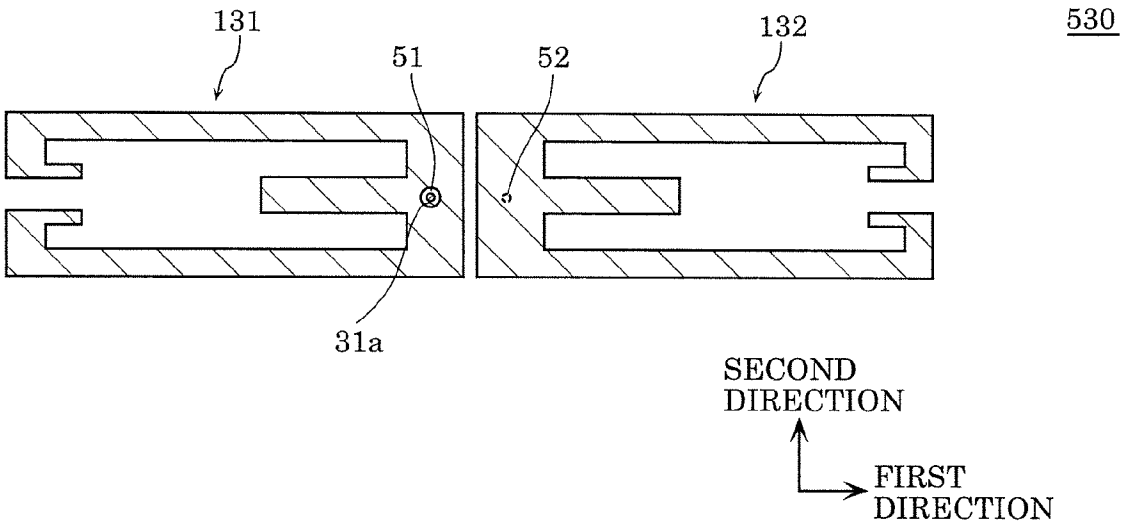
FIG. 19 is a top view of a second conductor layer of the antenna device according to Variation 13 of Embodiment 1.

An antenna device according to Variation 13 of the present embodiment will be described. The antenna device according to the present variation is different from the antenna device according to Variation 5 in the structure of the second conductor layer. With reference to FIG. 19, the configuration of the antenna device according to the present variation will be described, focusing on the difference from the antenna device according to Variation 5.

FIG. 19 is a top view of second conductor layer 530 of the antenna device according to the present variation. As shown in FIG. 19, second conductor layer 530 according to the present variation is different from second conductor layer 130 according to Variation 5 shown in FIG. 9 in that second conductor layer 530 does not include first intermediate element 33 and second intermediate element 34. The antenna device including second conductor layer 530 with the above structure achieves an effect similar to that of the antenna device according to Variation 5. Note, however, that the antenna device according to Variation 5 that includes second conductor layer 130 having first intermediate element 33 and second intermediate element 34 is capable of further widening the frequency band that can be used.

[1-3-14. Variation 14]

Figure 20:
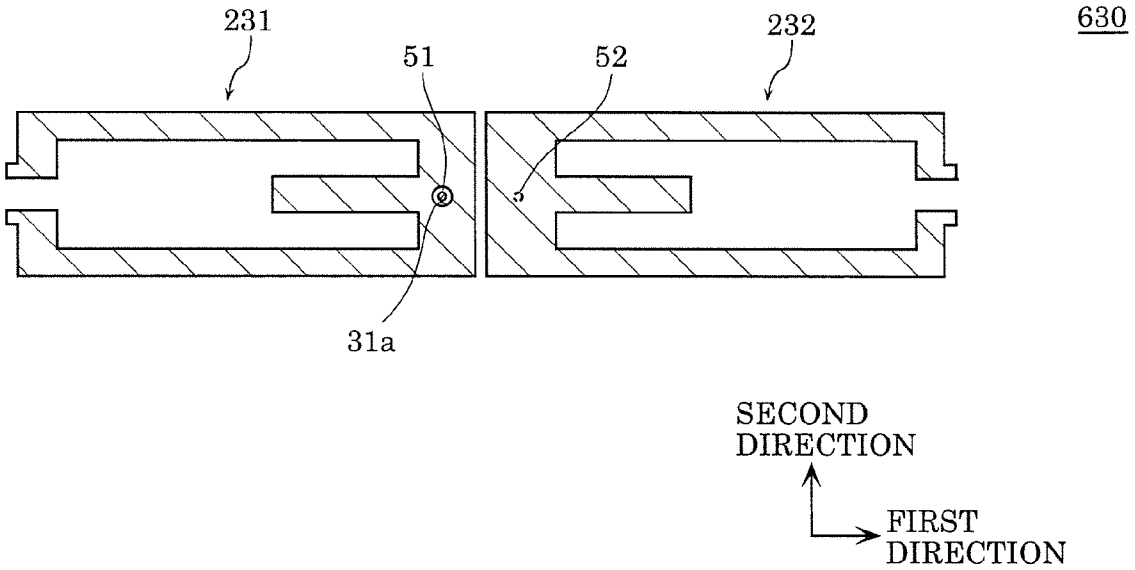
FIG. 20 is a top view of a second conductor layer of the antenna device according to Variation 14 of Embodiment 1.

An antenna device according to Variation 14 of the present embodiment will be described. The antenna device according to the present variation is different from the antenna device according to Variation 7 in the structure of the second conductor layer. With reference to FIG. 20, the configuration of the antenna device according to the present variation will be described, focusing on the difference from the antenna device according to Variation 7.

FIG. 20 is a top view of second conductor layer 630 of the antenna device according to the present variation. As shown in FIG. 20, second conductor layer 630 according to the present variation is different from second conductor layer 230 according to Variation 7 shown in FIG. 13 in that second conductor layer 630 does not include first intermediate element 33 and second intermediate element 34. The antenna device including second conductor layer 630 with the above structure achieves an effect similar to that of the antenna device according to Variation 7. Note, however, that the antenna device according to Variation 7 that includes second conductor layer 230 having first intermediate element 33 and second intermediate element 34 is capable of further widening the frequency band that can be used.

[1-4. Exemplary Placement of Antenna Device]

An exemplary placement of the above-described antenna device will be described. The following description uses a television receiver as an electrical appliance in which the antenna device is placed.

[1-4-1. Exemplary Placement 1]

Figure 21:
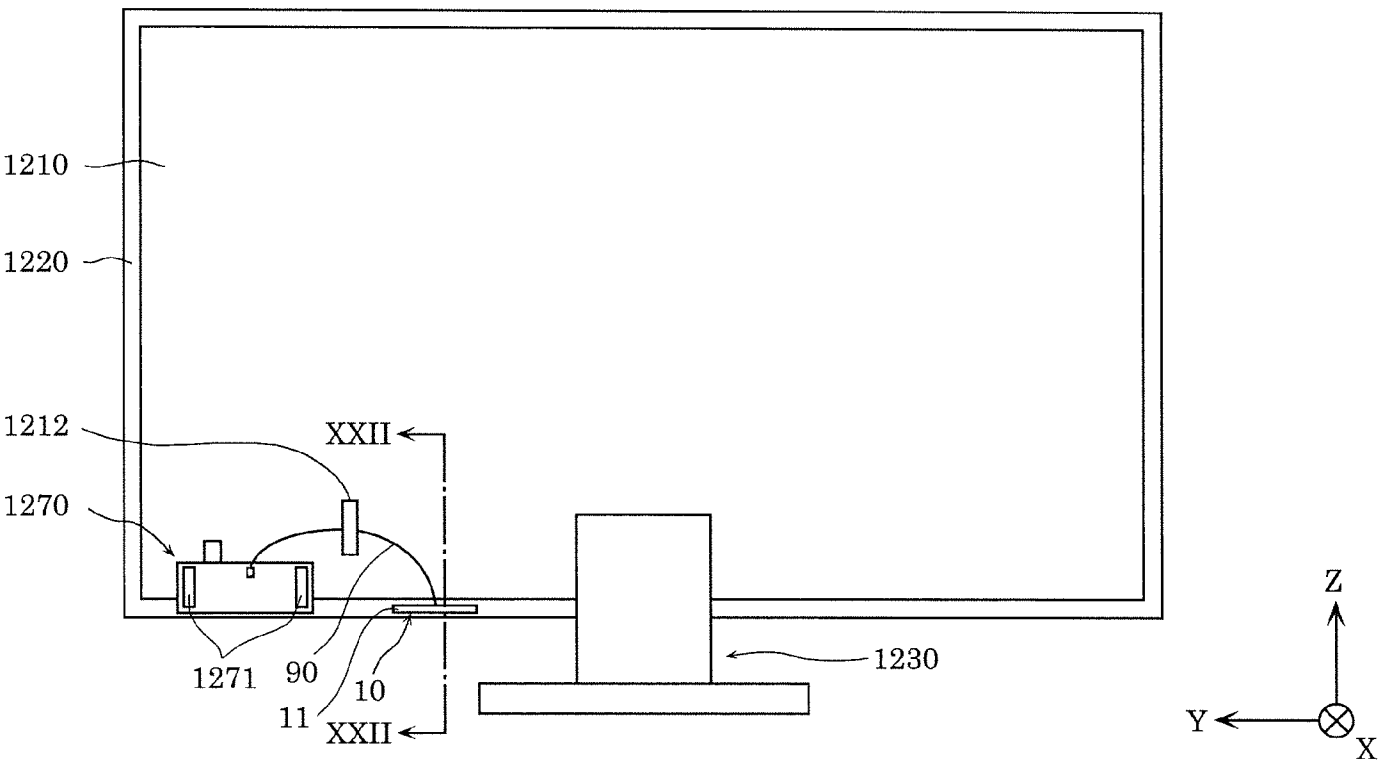
FIG. 21 is a rear view showing exemplary placement 1 of the antenna device according to Embodiment 1 in a television receiver.
Figure 22:
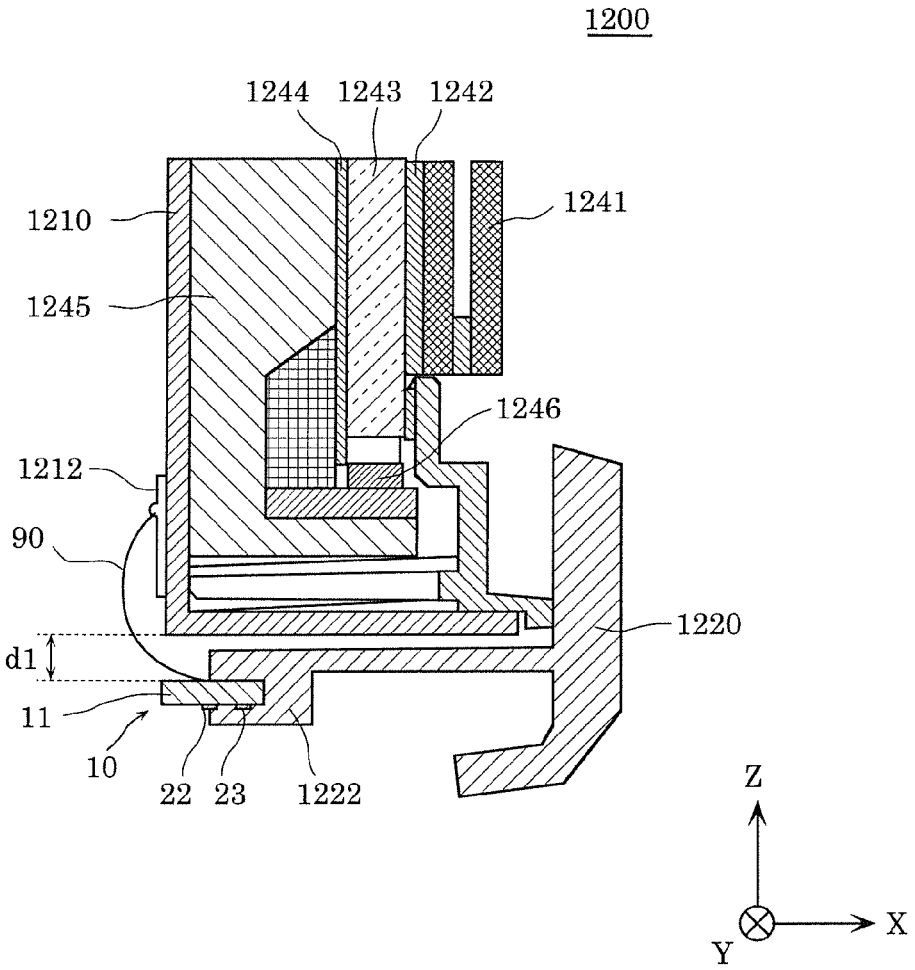
FIG. 22 is a cross-sectional view showing exemplary placement 1 of the antenna device according to Embodiment 1 in the television receiver.

With reference to FIG. 21 and FIG. 22, exemplary placement 1 of antenna device 10 according to Embodiment 1 will be described. FIG. 21 and FIG. 22 are a rear view and a cross-sectional view, respectively, showing exemplary placement 1 of antenna device 10 according to the present embodiment in television receiver 1200. FIG. 22 shows a cross-section taken along XXII-XXII line in FIG. 21. In FIG. 21 and FIG. 22, the vertical direction is defined as the Z-axis direction, and of the horizontal directions perpendicular to the vertical direction, the width direction of the screen of television receiver 1200 is defined as the Y-axis direction and the direction perpendicular to the screen of television receiver 1200 is defined as the X-axis direction.

As shown in FIG. 21, television receiver 1200 includes metallic baseplate 1210 that covers the rear surface, resin bezel 1220 that is placed in the frame of baseplate 1210, and leg portion 1230 that supports baseplate 1210 and bezel 1220. As shown in FIG. 22, television receiver 1200 includes liquid crystal cells 1241 that form a display panel placed at the front surface and optical sheet group 1242 that is placed at the rear surface of liquid crystal cells 1241. Television receiver 1200 further includes light guide plate 1243 that is placed at the rear surface of optical sheet group 1242, light emitting element 1246 that transmits light incident to light guide plate 1243, reflection sheet 1244 that is placed at the rear surface of light guide plate 1243, and radiator plate 1245 that is placed between reflection sheet 1244 and baseplate 1210. Note that the illustration of the circuit board and other structural components included in television receiver 1200 is omitted.

As shown in FIG. 21, television receiver 1200 includes antenna device 10 according to the present embodiment and wireless device 1270. Printed wiring board 11 of antenna device 10 is placed below the bottom surface of baseplate 1210. This placement increases the intensity of components radiated from antenna device 10 toward the front of television receiver 1200, compared to placing antenna device 10 at the rear surface of baseplate 1210.

Printed wiring board 11 is held by holding member 1222 included in bezel 1220. Holding member 1222 is placed below the bottom surface of baseplate 1210. In the present exemplary placement, as shown in FIG. 22, printed wiring board 11 is held in an orientation in which first conductor layer 20 is located lower than second conductor layer 30 in the vertical direction, and parasitic element 23 is located closer to the front surface of television receiver 1200 than feed element 21 and first grounding element 22. This placement enables parasitic element 23 to guide an electromagnetic wave radiated from feed element 21, thereby propagating the electromagnetic wave toward the front of television receiver 1200. The present exemplary placement further increases the intensity of components radiated toward the front surface, compared to placing printed wiring board 11 at the rear surface of baseplate 1210.

Wireless device 1270 includes antenna 1271. Wireless device 1270 provides high-frequency signals to antenna 1271 and antenna device 10, and processes the high-frequency signals received by antenna 1271 and antenna device 10. For example, wireless device 1270 provides, to antenna 1271, a high-frequency signal in the 2.4 GHz band compliant with a wireless LAN standard, and provides, to antenna device 10, a high-frequency signal in the 2.4 GHz band compliant with a Bluetooth® standard. Wireless device 1270 transmits high-frequency signals to and from printed wiring board 11 of antenna device 10 via coaxial cable 90 of antenna device 10. Note that the coaxial cable of antenna device 10 may be fixed onto baseplate 1210 with, for example, adhesive tape 1212. In the present exemplary placement, wireless device 1270 is placed in a position that is horizontally away from antenna device 10.

Although not illustrated in FIG. 21 and FIG. 22 for the purpose of showing the placement of antenna device 10 and so forth, a cover made of resin, for example, may be further included in television receiver 1200 for covering baseplate 1210, antenna device 10, wireless device 1270 and so forth.

Television receiver 1200 is required to include bezel 1220 having a reduced width from the standpoint of styling and downsizing. In general, to alleviate the influence caused by metallic baseplate 1210 on the radiation characteristics of the antenna, the antenna is required be distanced from baseplate 1210 at least by the distance that amounts to one fourth of the wavelength A of an electromagnetic wave (about 31 mm in the 2.4 GHz band). This makes it difficult to reduce the width of bezel 1220 when the antenna is placed in bezel 1220. However, antenna device 10 according to the present embodiment is capable of alleviating the influence caused by baseplate 1210 on the radiation characteristics owing to second conductor layer 30 of printed wiring board 11 serving as an AMC. The present embodiment achieves distance d1 of 5 mm from baseplate 1210 to printed wiring board 11. Antenna device 10 according to the present embodiment that is placed below the bottom surface of baseplate 1210 as described above increases the intensity of components radiated toward the front of television receiver 1200, while achieving the reduction in the width of bezel 1220.

Figure 23:
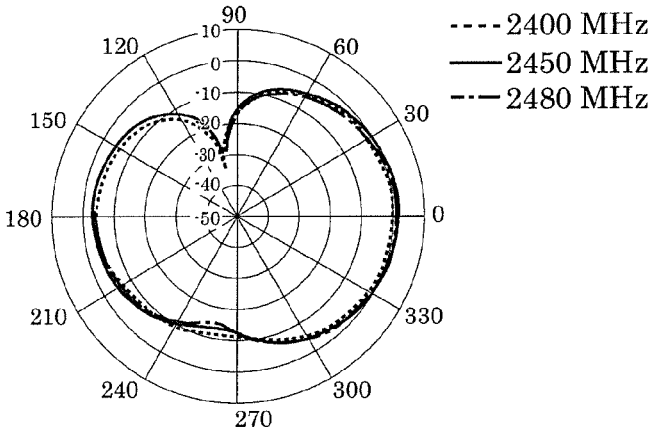
FIG. 23 is a graph showing a result of measuring the horizontal radiation characteristics of the antenna device alone according to Embodiment 1.
Figure 24:
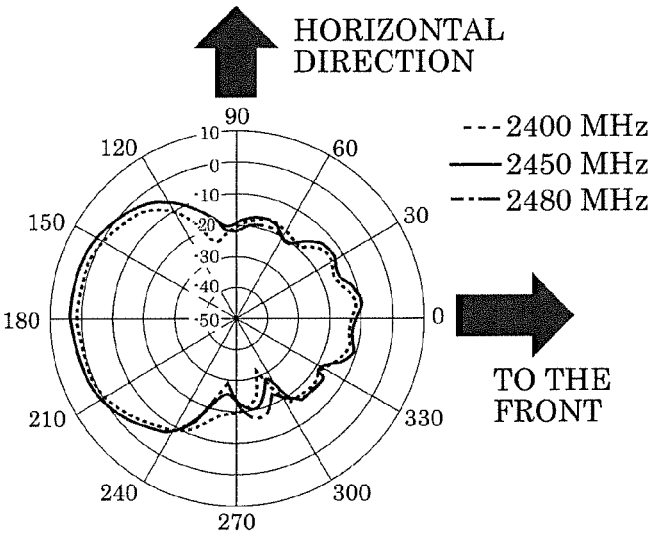
FIG. 24 is a graph showing a result of measuring the horizontal radiation characteristics when the antenna device according to Embodiment 1 is placed in the television receiver as shown in exemplary placement 1.

With reference to FIG. 23 and FIG. 24, the following describes the directional dependence of the radiation intensity from the antenna device according to the present embodiment. FIG. 23 is a graph showing a result of measuring the horizontal radiation characteristics of the antenna device alone according to the present embodiment. FIG. 24 is a graph showing a result of measuring the horizontal radiation characteristics when the antenna device according to the present embodiment is placed in television receiver 1200 as shown in the present exemplary placement. FIG. 23 and FIG. 24 show the radiation characteristics when the frequencies are 2400 MHz, 2450 MHz, and 2480 MHz. In the graphs in FIG. 23 and FIG. 24, the direction at 0 degrees indicates the direction from feed element 21 to parasitic element 23, and the direction at 180 degrees indicates the direction from parasitic element 23 to feed element 21. The direction at 90 degrees indicates the direction from first grounding element 22 to feed element 21, and the direction at 270 degrees indicates the direction from feed element 21 to first grounding element 22. In the graph in FIG. 24, the direction at 0 degrees indicates the direction toward the front of television receiver 1200, and the direction at 90 degrees indicates the horizontal direction. Note that the antenna device according to Variation 6 of the present embodiment was used to conduct the measurements shown in FIG. 23 and FIG. 24.

As shown in FIG. 23 and FIG. 24, the components radiated from antenna device 10 toward the front are securely obtained even when antenna device 10 is placed in television receiver 1200. As described above, antenna device 10 according to the present embodiment is capable of alleviating the influence caused by baseplate 1210 on the radiation characteristics owing to second conductor layer 30 serving as an AMC.

Also, as shown in FIG. 23 and FIG. 24, the antenna device according to the present embodiment reduces the intensity of components radiated toward the horizontal direction to smaller than the intensity of components radiated toward the front. This ensures the radiation intensity toward the front, while ensuring the isolation from wireless device 1270 that is placed horizontally away from the antenna device. Stated differently, the antenna device according to the present embodiment achieves improved directivity toward the front and improved isolation from antenna 1271 of wireless device 1270 that is placed horizontally away from the antenna device, compared to those achieved by the conventional antenna devices.

[1-4-2. Exemplary Placement 2]

Figure 25:
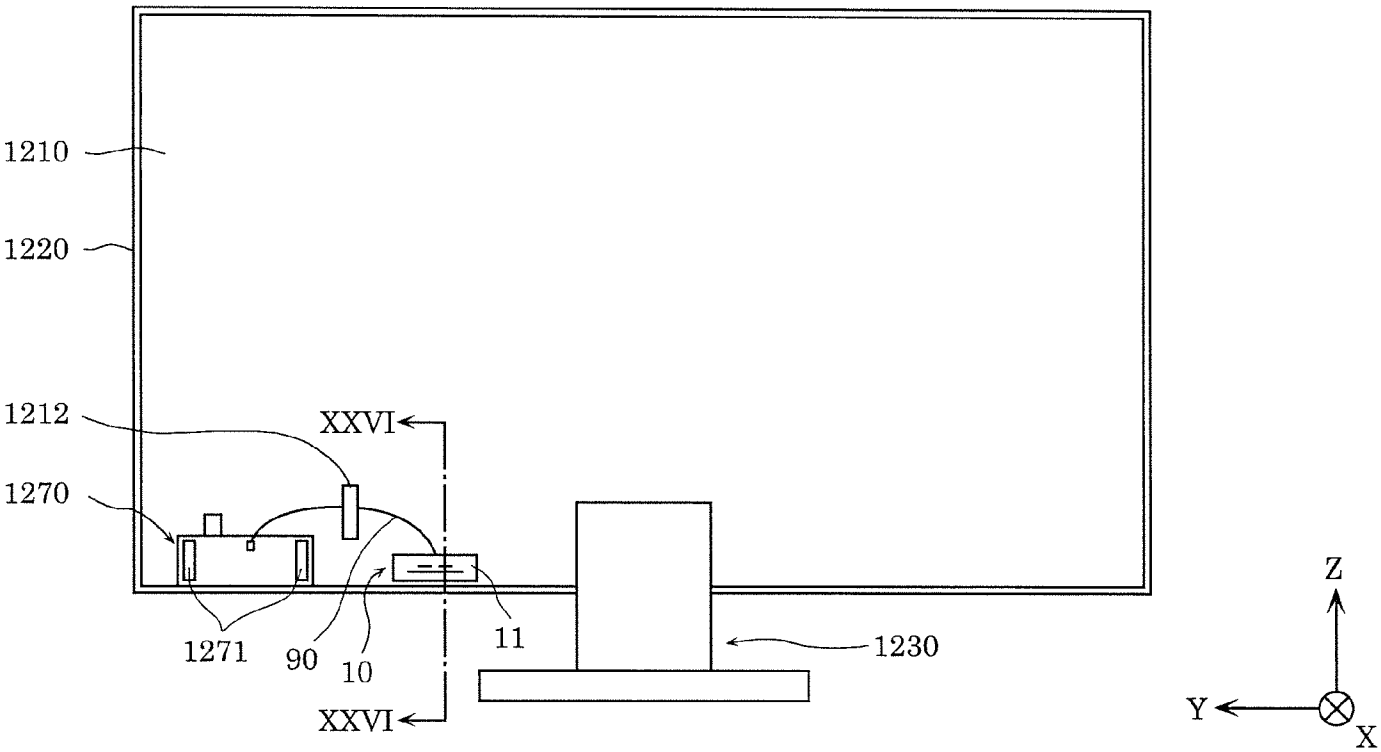
FIG. 25 is a rear view showing exemplary placement 2 of the antenna device according to Embodiment 1 in a television receiver.
Figure 26:
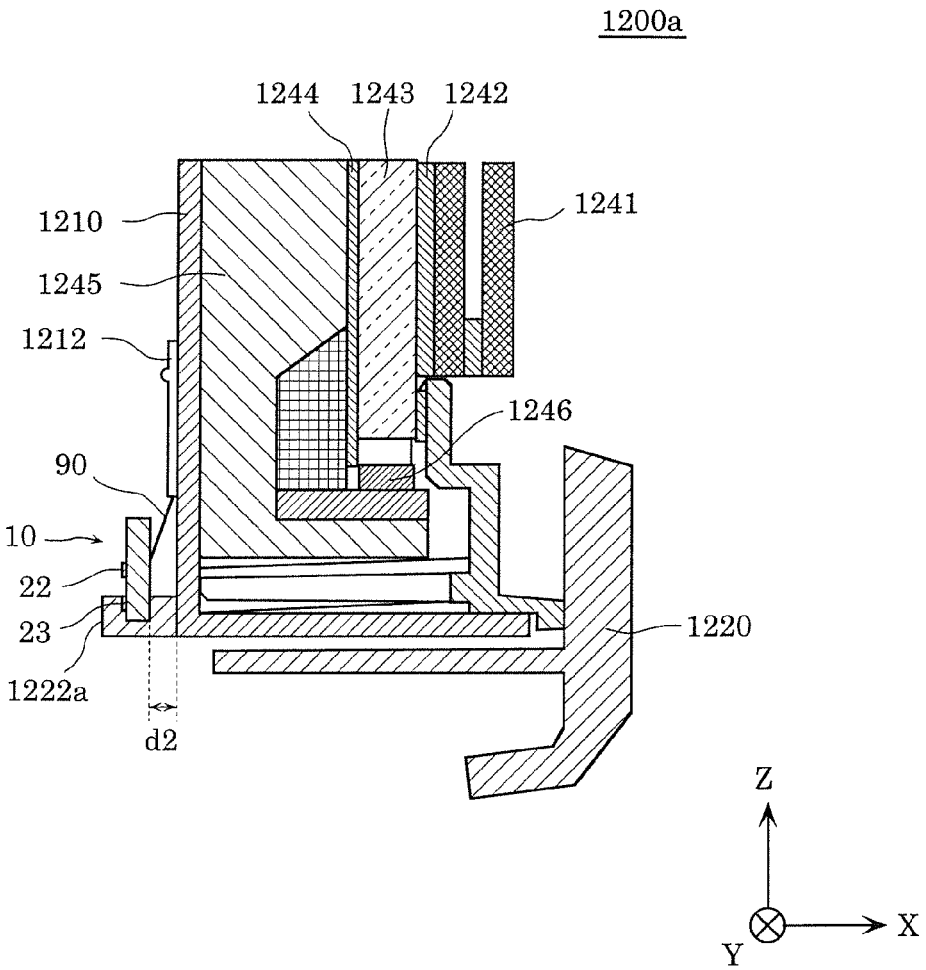
FIG. 26 is a cross-sectional view showing exemplary placement 2 of the antenna device according to Embodiment 1 in the television receiver.

With reference to FIG. 25 and FIG. 26, exemplary placement 2 of antenna device 10 according to Embodiment 1 will be described. FIG. 25 and FIG. 26 are a rear view and a cross-sectional view, respectively, showing exemplary placement 2 of antenna device 10 according to the present embodiment in television receiver 1200*a*. FIG. 26 shows a cross-section taken along XXVI-XXVI line in FIG. 25. Television receiver 1200*a* shown in FIG. 25 and FIG. 26 have a configuration similar to that of television receiver 1200 shown in FIG. 21, etc., except for the configuration relating to the placement of antenna device 10.

As shown in FIG. 25 and FIG. 26, printed wiring board 11 of antenna device 10 according to the present exemplary placement is placed in a position that is at the rear surface side of baseplate 1210 and horizontally away from wireless device 1270. As shown in FIG. 26, printed wiring board 11 is held by resin holding member 1222*a* that is attached to baseplate 1210. As shown in FIG. 26, printed wiring board 11 is held in an orientation in which first conductor layer 20 is located closer to the rear surface than second conductor layer 30. Stated differently, first conductor layer 20 is placed further from baseplate 1210 than second conductor layer 30. Printed wiring board 11 is held in an orientation in which parasitic element 23 is located lower than feed element 21 and first grounding element 22 in the vertical direction. This placement enables parasitic element 23 to guide an electromagnetic wave radiated from feed element 21, thereby propagating the electromagnetic wave toward the front of television receiver 1200*a* via a space below baseplate 1210.

Antenna device 10 according to the present embodiment is capable of alleviating the influence caused by baseplate 1210 on the radiation characteristics owing to second conductor layer 30 of printed wiring board 11 serving as an AMC. The present exemplary placement achieves distance d2 of 6 mm from baseplate 1210 to printed wiring board 11.

Figure 27:
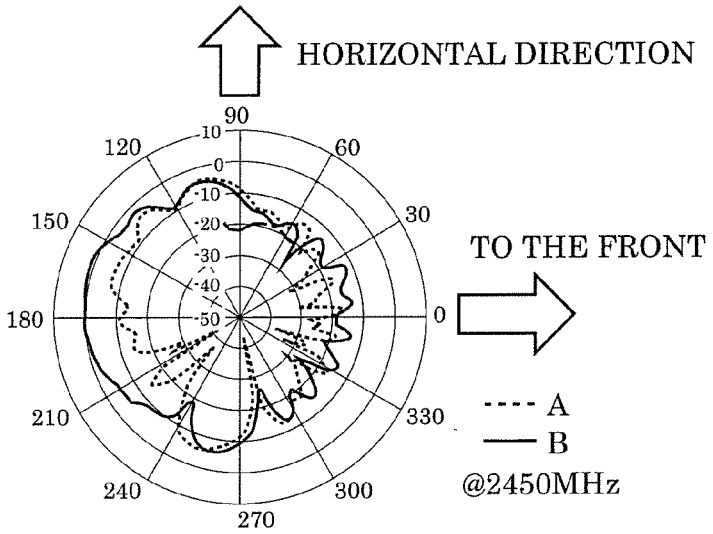
FIG. 27 is a graph showing a result of measuring the horizontal radiation characteristics when the antenna device according to Embodiment 1 is placed in the television receiver as shown in exemplary placement 2.

With reference to FIG. 27, the radiation characteristics of the antenna device placed in the above manner will be described. FIG. 27 is a graph showing a result of measuring the horizontal radiation characteristics when the antenna device according to the present embodiment is placed in television receiver 1200*a* as shown in the present exemplary placement. In the graph shown in FIG. 27, dotted line A and solid line B show measurement results obtained when the antenna devices according to Variation 6 and Variation 12 are used, respectively. In the graph in FIG. 27, the direction at 0 degrees indicates the direction toward the front of television receiver 1200*a*, and of the horizontal directions, the direction at 90 degrees indicates the direction toward wireless device 1270.

As shown in FIG. 27, the radiation characteristics of Variation 12 indicated by solid line B have a greater radiation intensity toward the front. Stated differently, in exemplary placement 2, the antenna device that includes the second conductor layer having the third intermediate element and the fourth intermediate element is capable of increasing the radiation intensity toward the front of television receiver 1200*a*.

Embodiment 2

An antenna device according to Embodiment 2 will be described. The antenna device according to the present embodiment is different from antenna device 10 according to Embodiment 1 in that a wireless circuit and for forth are integrated. The following describes the antenna device according to the present embodiment, focusing on the difference from antenna device 10 according to Embodiment 1.

[2-1. Configuration of Antenna Device]

Figure 28:
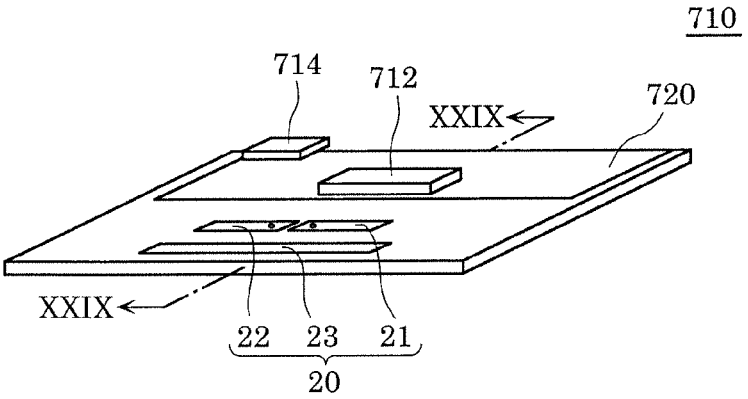
FIG. 28 is a perspective view of the configuration of an antenna device according to Embodiment 2.
Figure 29:
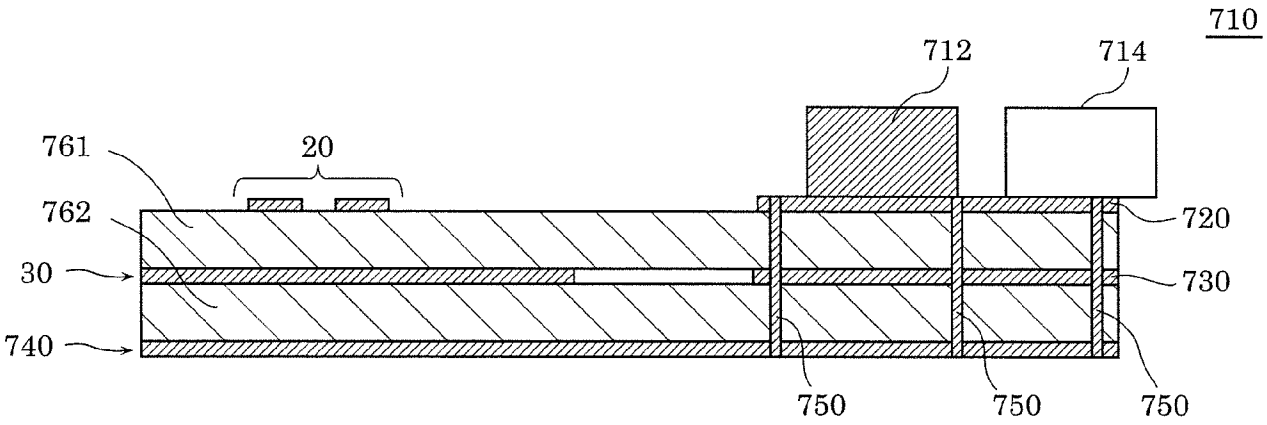
FIG. 29 is a cross-sectional view of the configuration of the antenna device according to Embodiment 2.

With reference to FIG. 28 and FIG. 29, the configuration of the antenna device according to the present embodiment will be described. FIG. 28 and FIG. 29 are a perspective view and a cross-sectional view, respectively, showing the configuration of antenna device 710 according to the present embodiment. FIG. 29 shows a cross-section taken along XXIX-XXIX line shown in FIG. 28.

As shown in FIG. 29, antenna device 710 according to the present embodiment includes first conductor layer 20, second conductor layer 30, third conductor layer 740, first dielectric layer 761, second dielectric layer 762, first wiring layer 720, second wiring layer 730, wireless circuit 712, connector 714, and through-hole electrode 750.

First conductor layer 20 and second conductor layer 30 have structures similar to those of first conductor layer 20 and second conductor layer 30 according to Embodiment 1.

Third conductor layer 740 includes a conductor that is grounded as in the case of third conductor layer 40 according to Embodiment 1. Third conductor layer 740 extends to a position that is opposite to wireless circuit 712, and is used as a ground pattern conductor of wireless circuit 712. Stated differently, the ground pattern conductor is shared use between: wireless circuit 712; and first conductor layer 20, second conductor layer 30, and third conductor layer 740 that form the antenna of antenna device 710.

First dielectric layer 761 is a dielectric layer that is located between first conductor layer 20 and second conductor layer 30. First dielectric layer 761 is also located between first wiring layer 720 and second wiring layer 730.

Second dielectric layer 762 is a dielectric layer that is located between second conductor layer 30 and third conductor layer 740. Second dielectric layer 762 is also located between second wiring layer 730 and third conductor layer 740.

Wireless circuit 712 is a circuit that provides high-frequency signals to feed element 21 and first grounding element 22 of first conductor layer 20, and processes the high-frequency signals received by feed element 21 and first grounding element 22. Wireless circuit 712 is implemented, for example, as an integrated circuit (IC) chip. Wireless circuit 712 is mounted on first wiring layer 720 on first dielectric layer 761. This enables wireless circuit 712 and feed element 21 to be electrically connected with each other via first wiring layer 720 and so forth.

Connector 714 is a component that connects antenna device 710 with another device. Connector 714 is used to obtain a signal transmitted from antenna device 710 and output a signal received by antenna device 710. Connector 714 may supply power. Connector 714 is mounted on first wiring layer 720 on first dielectric layer 761.

First wiring layer 720 is a conductor layer on which patterned wiring is formed that connects wireless circuit 712, connector 714, and feed element 21.

Second wiring layer 730 is a conductor layer on which patterned wiring is formed that connects wireless circuit 712, connector 714, and feed element 21. Second wiring layer 730 is not necessarily provided.

First wiring layer 720, second wiring layer 730, and third conductor layer 740 may be connected via through-hole electrode 750.

Antenna device 710 with the above configuration achieves an effect similar to that of antenna device 10 according to Embodiment 1.

[2-2. Exemplary Placement of Antenna Device]

Figure 30:
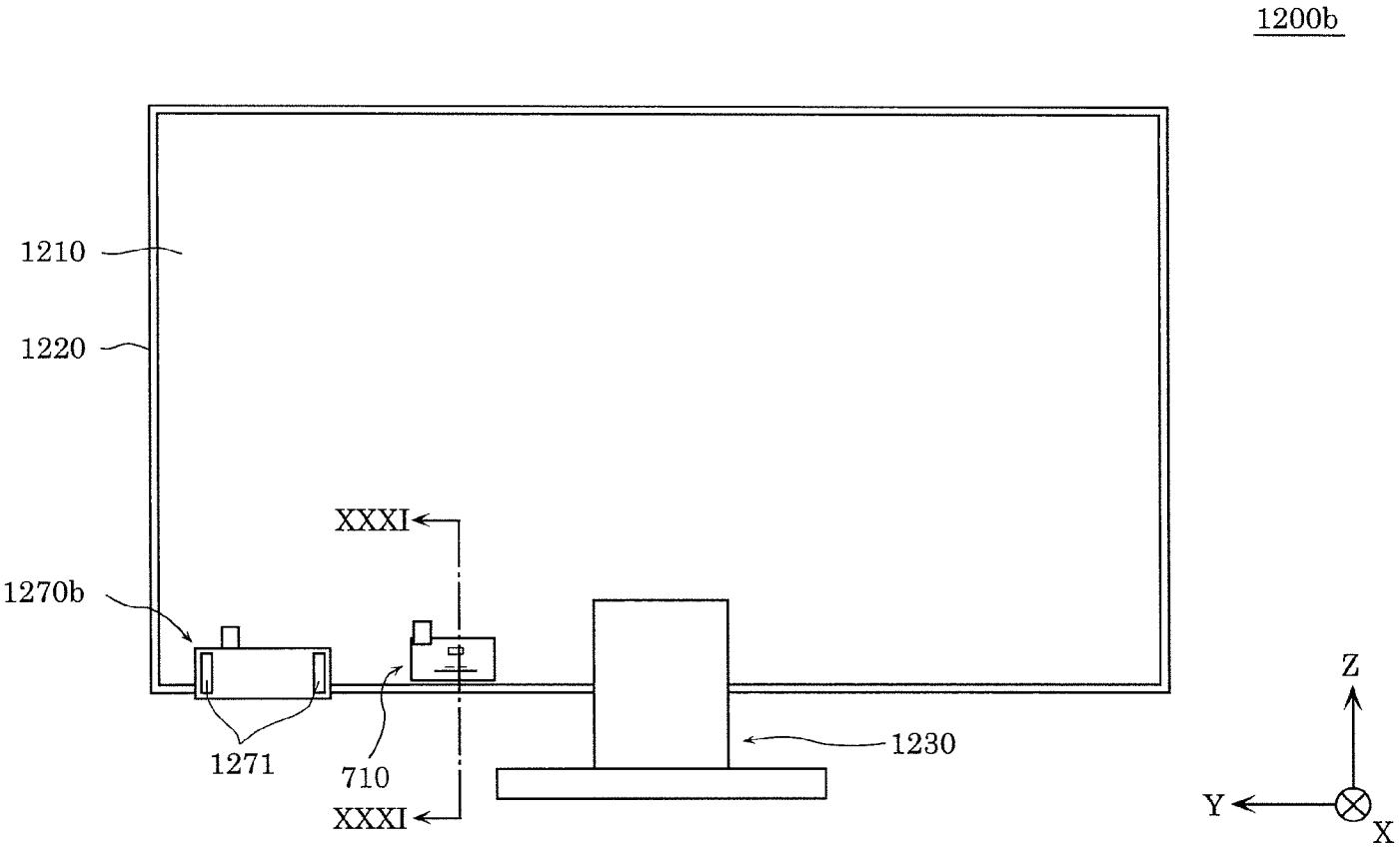
FIG. 30 is a rear view showing an exemplary placement of the antenna device according to Embodiment 2 in a television receiver.
Figure 31:
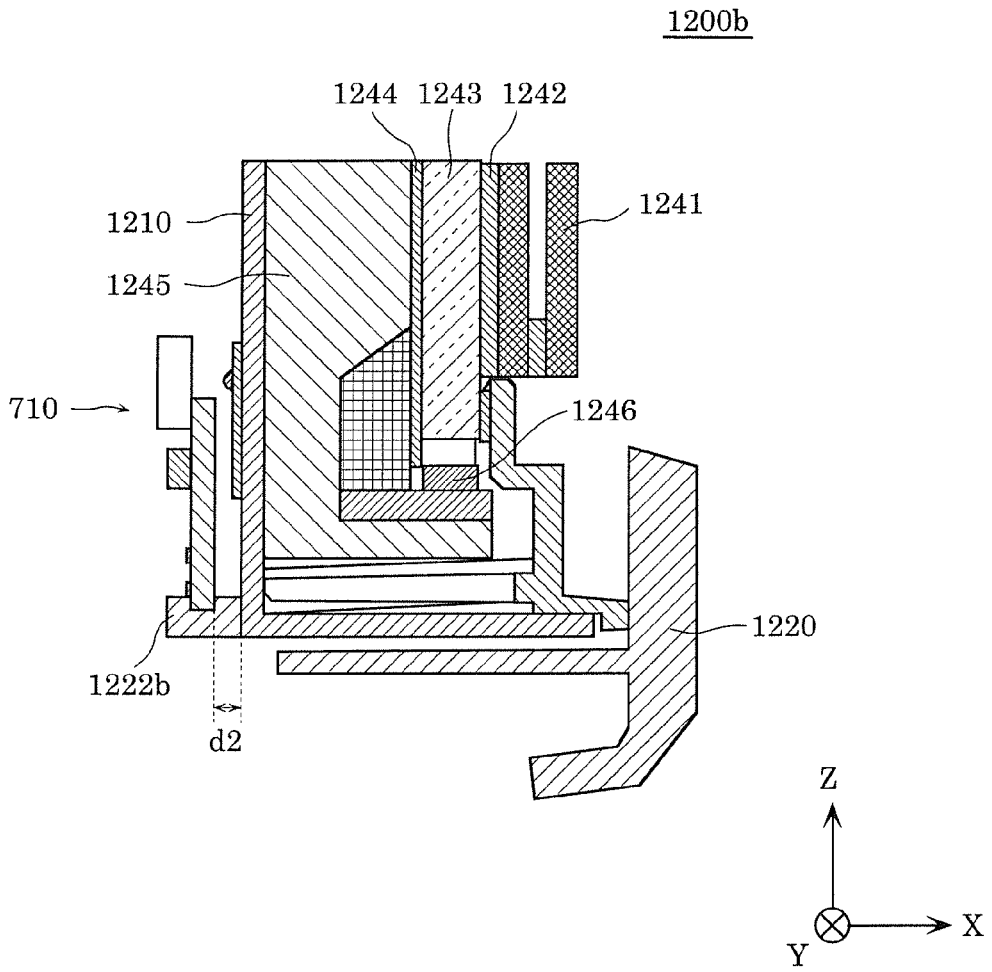
FIG. 31 is a cross-sectional view showing an exemplary placement of the antenna device according to Embodiment 2 in the television receiver.

With reference to FIG. 30 and FIG. 31, an exemplary placement of antenna device 710 according to the present embodiment will be described. FIG. 30 and FIG. 31 are a rear view and a cross-sectional view, respectively, showing an exemplary placement of antenna device 710 according to the present embodiment in television receiver 1200*b*. FIG. 31 shows a cross-section taken along XXXI-XXXI line in FIG. 30.

As shown in FIG. 30, television receiver 1200*b* includes wireless device 1270*b* and antenna device 710 according to the present embodiment. Television receiver 1200*b* is different from television receiver 1200*a* shown in FIG. 25 in the configurations of wireless device 1270*b* and antenna device 710, and agrees with the other points.

Wireless device 1270*b* is different from wireless device 1270 shown in FIG. 25 in that wireless device 1270*b* does not include a wireless circuit for antenna device 710, and agrees with the other points.

Antenna device 710 is placed in a position that is at the rear surface side of baseplate 1210 and horizontally away from wireless device 1270*b*. As shown in FIG. 31, antenna device 710 is held by resin holding member 1222*b* that is attached to baseplate 1210. Antenna device 710 is held in an orientation in which first conductor layer 20 is located closer to the rear surface than second conductor layer 30. Stated differently, first conductor layer 20 is located further from baseplate 1210 than second conductor layer 30. Antenna device 710 is held in an orientation in which parasitic element 23 is located lower than feed element 21 and first grounding element 22 in the vertical direction. This placement enables parasitic element 23 to guide an electromagnetic wave radiated from feed element 21, thereby propagating the electromagnetic wave toward the front of television receiver 1200*b* via a space below baseplate 1210, as in the case of exemplary placement 2 of antenna device 10 according to Embodiment 1.

Antenna device 710 according to the present embodiment is capable of alleviating the influence caused by baseplate 1210 on the radiation characteristics owing to second conductor layer 30 serving as an AMC. The present embodiment achieves distance d2 of 6 mm from baseplate 1210 to antenna device 710.

Embodiment 3

An antenna device according to Embodiment 3 will be described. The antenna device according to the present embodiment is different from the antenna device according to Embodiment 2 in the placement of the wireless circuit and so forth. The following describes the antenna device according to the present embodiment, focusing on the difference from the antenna device according to Embodiment 2.

[3-1. Configuration of Antenna Device]

Figure 32:
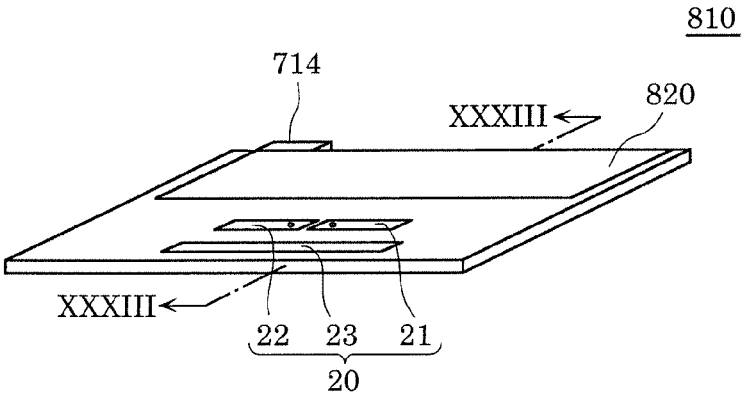
FIG. 32 is a perspective view of the configuration of an antenna device according Embodiment 3.
Figure 33:
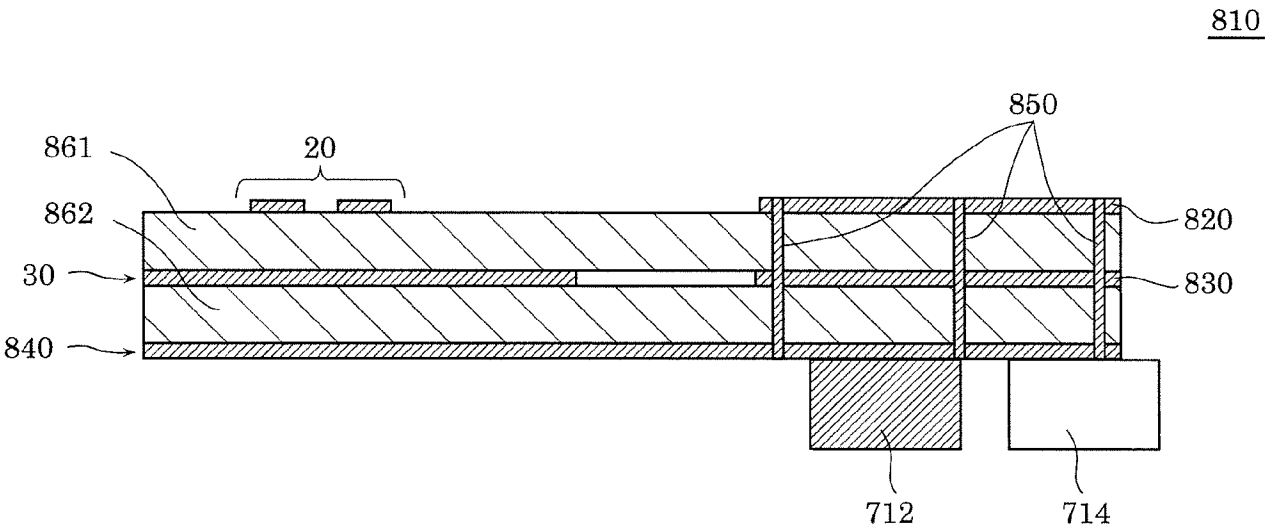
FIG. 33 is a cross-sectional view of the configuration of the antenna device according to Embodiment 3.

With reference to FIG. 32 and FIG. 33, the configuration of the antenna device according to the present embodiment will be described. FIG. 32 and FIG. 33 are a perspective view and a cross-sectional view, respectively, showing the configuration of antenna device 810 according to the present embodiment. FIG. 33 shows a cross-section taken along XXXIII-XXXIII line shown in FIG. 32.

As shown in FIG. 33, antenna device 810 according to the present embodiment includes first conductor layer 20, second conductor layer 30, third conductor layer 840, first dielectric layer 861, second dielectric layer 862, first wiring layer 820, second wiring layer 830, wireless circuit 712, connector 714, and through-hole electrode 850.

First conductor layer 20 and second conductor layer 30 have structures similar to those of first conductor layer 20 and second conductor layer 30 according to Embodiment 1.

Third conductor layer 840 includes a conductor that is grounded as in the case of third conductor layer 40 according to Embodiment 1. Third conductor layer 840 extends to a region where wireless circuit 712 and so forth are mounted, and is used as a ground pattern conductor of wireless circuit 712. Stated differently, the ground pattern conductor is shared use between: wireless circuit 712; and first conductor layer 20, second conductor layer 30, and third conductor layer 840 that form the antenna of antenna device 810. Third conductor layer 840 according to the present embodiment also includes a wiring layer connected to wireless circuit 712 and so forth.

First dielectric layer 861 is a dielectric layer that is located between first conductor layer 20 and second conductor layer 30. First dielectric layer 861 is also located between first wiring layer 820 and second wiring layer 830.

Second dielectric layer 862 is a dielectric layer that is located between second conductor layer 30 and third conductor layer 840. Second dielectric layer 862 is also located between second wiring layer 830 and third conductor layer 840.

Wireless circuit 712 is a circuit similar to wireless circuit 712 according to Embodiment 2. Wireless circuit 712 is mounted on third conductor layer 840 on second dielectric layer 862. This enables wireless circuit 712 and feed element 21 to be electrically connected with each other via the wiring layer and so forth.

Connector 714 is a component similar to connector 714 according to Embodiment 2. Connector 714 is mounted on third conductor layer 840 on second dielectric layer 862.

First wiring layer 820 is a conductor layer on which patterned wiring is formed that connects wireless circuit 712, connector 714, and feed element 21.

Second wiring layer 830 is a conductor layer on which patterned wiring is formed that connects wireless circuit 712, connector 714, and feed element 21. Second wiring layer 830 is not necessarily provided.

First wiring layer 820, second wiring layer 830, and third conductor layer 840 may be connected via through-hole electrode 850.

Antenna device 810 with the above configuration achieves an effect similar to that of antenna device 710 according to Embodiment 2.

[3-2. Exemplary Placement of Antenna Device]

Figure 34:
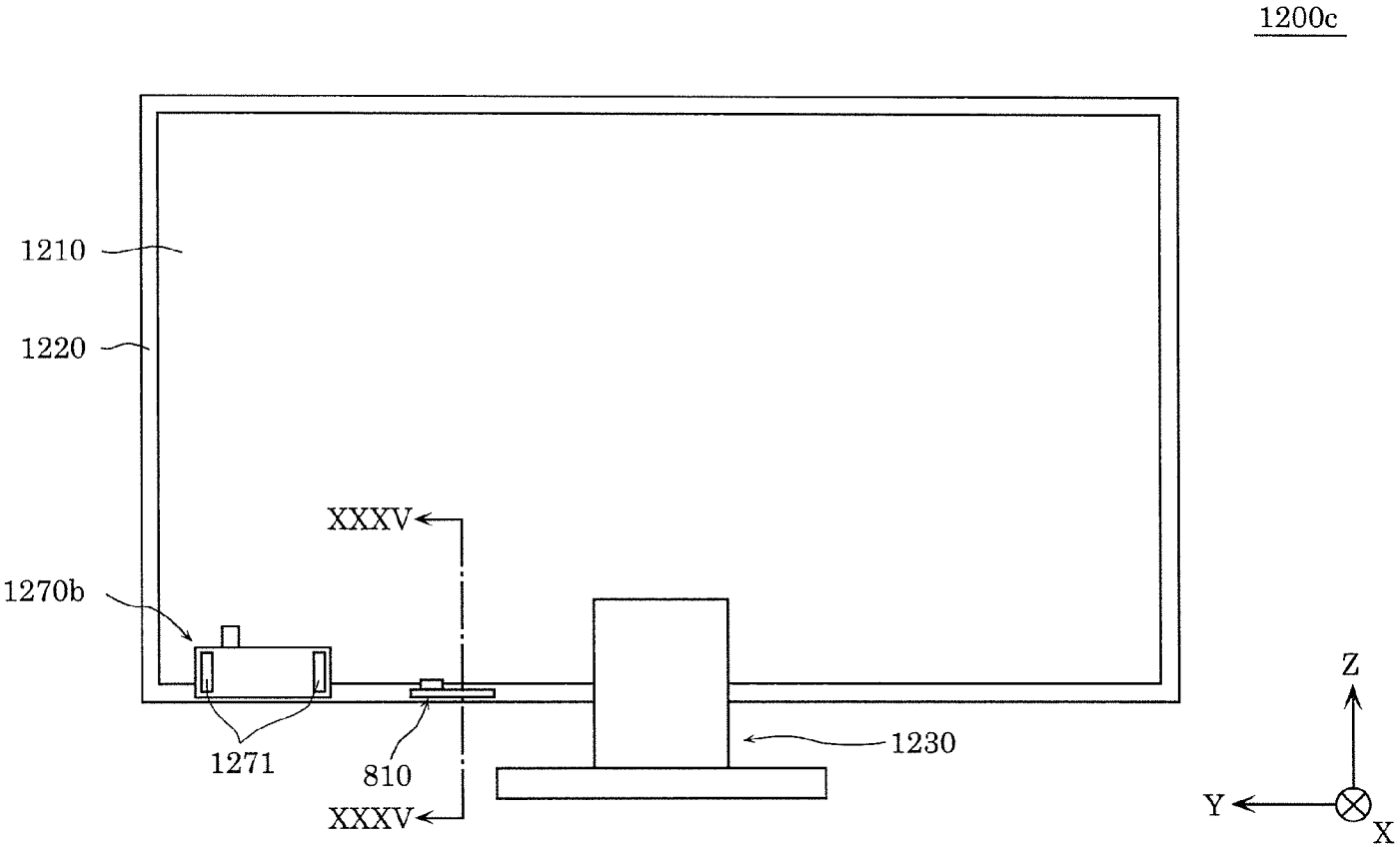
FIG. 34 is a rear view showing an exemplary placement of the antenna device according to Embodiment 3 in a television receiver.
Figure 35:
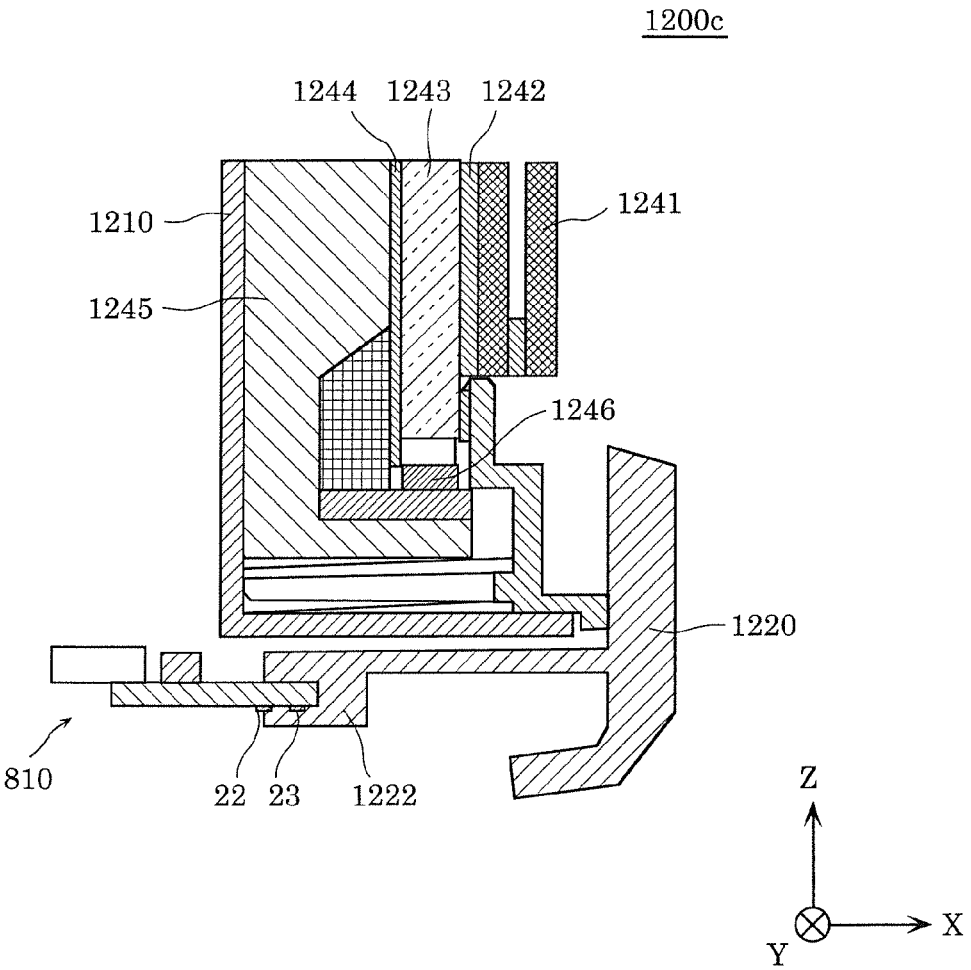
FIG. 35 is a cross-sectional view showing an exemplary placement of the antenna device according to Embodiment 3 in the television receiver.

With reference to FIG. 34 and FIG. 35, an exemplary placement of antenna device 810 according to the present embodiment will be described. FIG. 34 and FIG. 35 are a rear view and a cross-sectional view, respectively, showing an exemplary placement of antenna device 810 according to the present embodiment in television receiver 1200*c*. FIG. 35 shows a cross-section taken along XXXV-XXXV line in FIG. 34.

As shown in FIG. 35, television receiver 1200*c* includes wireless device 1270*b* and antenna device 810 according to the present embodiment. Television receiver 1200*c* is different from television receiver 1200*b* according to Embodiment 2 in the configuration and the placement of antenna device 810, and agrees with the other points.

Antenna device 810 is placed in a position that is below the bottom surface of baseplate 1210 and horizontally away from wireless device 1270*b*. As shown in FIG. 35, antenna device 810 is held by holding member 1222 included in bezel 1220. Antenna device 810 is held in an orientation in which first conductor layer 20 is located lower than second conductor layer 30 in the vertical direction and parasitic element 23 is located closer to the front surface side of television receiver 1200*c* than feed element 21 and first grounding element 22. This placement enables parasitic element 23 to guide an electromagnetic wave radiated from feed element 21, thereby propagating the electromagnetic wave toward the front of television receiver 1200*c*.

Another Embodiment

Embodiments 1 through 3 and variations of Embodiment 1 have been described above to illustrate the technology disclosed in the present application. Note, however, that the technology according to the present disclosure is not limited to them, and thus is applicable to an embodiment obtained by making modifications, replacements, additions, omissions and so forth, where appropriate. Also, structural components described in Embodiments 1 through 3 and variations of Embodiment 1 may be combined to be a new embodiment.

For example, the foregoing embodiments and so forth have shown an exemplary configuration in which a television receiver includes an antenna device, but the electrical appliance including the antenna device is not limited to a television receiver. An audio player, for example, may thus include the antenna device.

The antenna device according to Embodiment 1 includes coaxial cable 90 but the antenna device does not necessarily include coaxial cable 90. A line in another form may be used to provide high-frequency signals to the antenna device.

Also, the foregoing embodiments use the conductor layers that are prepared on the dielectric layers by use of copper foil, but the conductor layers may be prepared by use of sheet metal or by means of metallic deposition.

The embodiments have been described above to illustrate the technology according to the present disclosure, for which the accompanying drawings and detailed description have been provided.

To illustrate the above technology, the structural components described in the accompanying drawings and detailed description can thus include not only the structural components essential to solve the issue, but also structural components unessential to solve the issue. Therefore, the fact that such unessential structural components are illustrated in the accompanying drawings and detailed description should not lead to the immediate conclusion that such unessential structural components are essential.

Also note that the above-described embodiments are intended for illustrating the technology according to the present disclosure, and thus allow for various modifications, replacements, additions, omissions and so forth made thereto within the scope of the claims and its equivalent scope.

For example, the floating element and the second grounding element in some of the antenna devices according to Embodiment 1 and its variations described above have been described as forming a shape that is asymmetric with respect to the second gap. Such structure is applicable to all of the embodiments and their variations described above. More specifically, the second grounding element in any of the antenna devices may be shorter than the floating element in the first direction. In this case, the length of that portion in the third conductor layer which is opposite to the second grounding element can be shorter in the first direction. Similarly, the lengths of those portions in the first dielectric layer and the second dielectric layer which are opposite to the second grounding element can be shorter in the first direction. The second grounding element having a shorter length in the first direction than the length of the floating element in the first direction as described above results in a reduced length in the first direction of the entire antenna device. Stated differently, the antenna device can be further downsized. This consequently provides a higher flexibility in placing the antenna device. Such configuration achieves a similar effect that is achieved by the configuration in which the length in the second grounding element in the first direction is substantially equal to the length of the floating element in the first direction.

INDUSTRIAL APPLICABILITY

The present disclosure is applicable for use in a television receiver and so forth as an antenna device that is excellent in directivity and in isolation from another wireless device.

The invention claimed is:

1. An antenna device, comprising:

a first conductor layer;

a second conductor layer that is located opposite to the first conductor layer;

a first dielectric layer that is located between the first conductor layer and the second conductor layer;

a third conductor layer that is located opposite to the second conductor layer; and a second dielectric layer that is located between the second conductor layer and the third conductor layer, wherein the first conductor layer includes:

a feed element to which power is supplied;

a first grounding element that is located next to the feed element in a first direction via a first gap and grounded; and a parasitic element that is located along the feed element and the first grounding element and insulated from the feed element and the first grounding element, the second conductor layer includes:

a floating element that is located opposite to the feed element and the parasitic element and insulated from the first conductor layer;

a second grounding element that is located opposite to the first grounding element and the parasitic element and next to the floating element in the first direction via a second gap, and grounded;

a first intermediate element that is located, in the second gap, opposite to the parasitic element and extends in a second direction that intersects the first direction; and a second intermediate element that is located, in the second gap, next to the first intermediate element in the second direction via a third gap and extends in the second direction, and the third gap at least partially overlaps at least one of the feed element, the first grounding element, and the first gap in a plan view of the first conductor layer, and the third conductor layer includes a third grounding element that is located opposite to the floating element and the second grounding element and grounded.

2. The antenna device according to claim 1, wherein the floating element and the second grounding element form a shape that is asymmetric with respect to the second gap.

3. The antenna device according to claim 1, wherein the first gap at least partially overlaps the second gap in a plan view of the first conductor layer.

4. The antenna device according to claim 1, wherein the first intermediate element is connected to the second grounding element at an end further from the third gap, and the second intermediate element is connected to the second grounding element at an end further from the third gap.

5. The antenna device according to claim 1, wherein the second conductor layer further includes:

a third intermediate element that is located, between the first intermediate element and the floating element, opposite to the parasitic element and extends in the second direction; and a fourth intermediate element that is located next to the third intermediate element in the second direction via a fourth gap and extends in the second direction, and the fourth gap at least partially overlaps at least one of the feed element, the first grounding element, and the first gap in the plan view of the first conductor layer.

6. The antenna device according to claim 5, wherein the third intermediate element is connected to the floating element at an end further from the fourth gap, and the fourth intermediate element is connected to the floating element at an end further from the fourth gap.

7. The antenna device according to claim 1, wherein the parasitic element at least partially overlaps the second gap in a plan view of the first conductor layer.

8. The antenna device according to claim 1, wherein the parasitic element is longer in the first direction than a sum of lengths of the feed element, the first gap, and the first grounding element.

9. An electrical appliance that includes the antenna device according to claim 1.

* * * * *